US005944493A

United States Patent [19]

Albertin et al.

[11] Patent Number: 5,944,493

[45] Date of Patent: Aug. 31, 1999

[54] RADIAL PISTON FLUID MACHINE AND/OR ADJUSTABLE ROTOR

[75] Inventors: Marc S. Albertin, Atlanta; Rodney D. Hugelman, Champaign, both of Ill.

[73] Assignee: Whitemoss, Inc., West Lafayette, Ind.

[21] Appl. No.: 08/865,601

[22] Filed: May 29, 1997

Related U.S. Application Data

[62] Division of application No. 08/316,119, Sep. 30, 1994, Pat. No. 5,634,777, which is a continuation-in-part of application No. 07/955,902, filed as application No. PCT/US91/04575, Jun. 26, 1991, Pat. No. 5,377,559, which is a continuation-in-part of application No. 07/546,373, Jun. 29, 1990, abandoned, and application No. 08/293,793, Aug. 22, 1994, Pat. No. 5,547,348, which is a division of application No. 07/955,902.

[51] Int. Cl.[6] ..... F04B 1/04; F01B 1/06

[52] U.S. Cl. ..... 417/273; 91/481; 91/492; 91/497; 92/12.1

[58] Field of Search ..... 417/273, 221; 74/122, 123, 124, 125, 571 M, 571 L, 571 R; 92/12.1; 91/481, 492, 497

[56] References Cited

U.S. PATENT DOCUMENTS

| | | | |
|---|---|---|---|
| 682,389 | 9/1901 | Riley | 91/481 X |
| 1,875,180 | 8/1932 | Rider | 74/571 M X |
| 1,982,958 | 12/1934 | Kraus | 74/571 M |
| 1,988,571 | 1/1935 | Rider | 74/571 M X |
| 2,062,241 | 11/1936 | Viberg | 74/117 |
| 2,088,582 | 8/1937 | Bishop | 91/481 X |
| 2,414,003 | 1/1947 | Thompson | 74/571 M |
| 3,695,146 | 10/1972 | Orshansky, Jr. | 91/481 X |

*Primary Examiner*—John Rivell
*Attorney, Agent, or Firm*—Knechtel, Demeur & Samlan

[57] ABSTRACT

An adjustable rotor and/or a radial piston machine which may utilize an adjustable rotor. The rotor has a primary eccentric rotatable around an axis and a secondary eccentric adjustable in position relative to the primary eccentric. The radial piston machine includes a plurality of piston cartridges arranged radially around the axis and both high pressure and low pressure fluid distribution systems. Multiple units may be axially coupled. A single unit may handle a variety of fluids in various combinations.

4 Claims, 24 Drawing Sheets

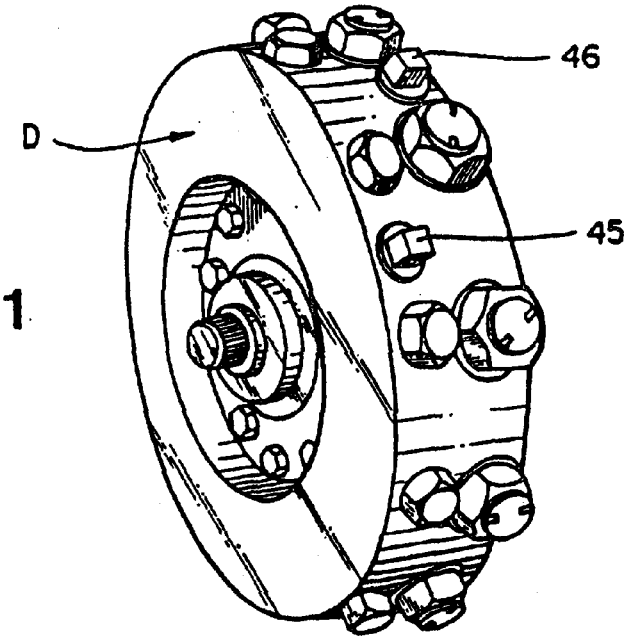
Fig. 1
Fig. 2
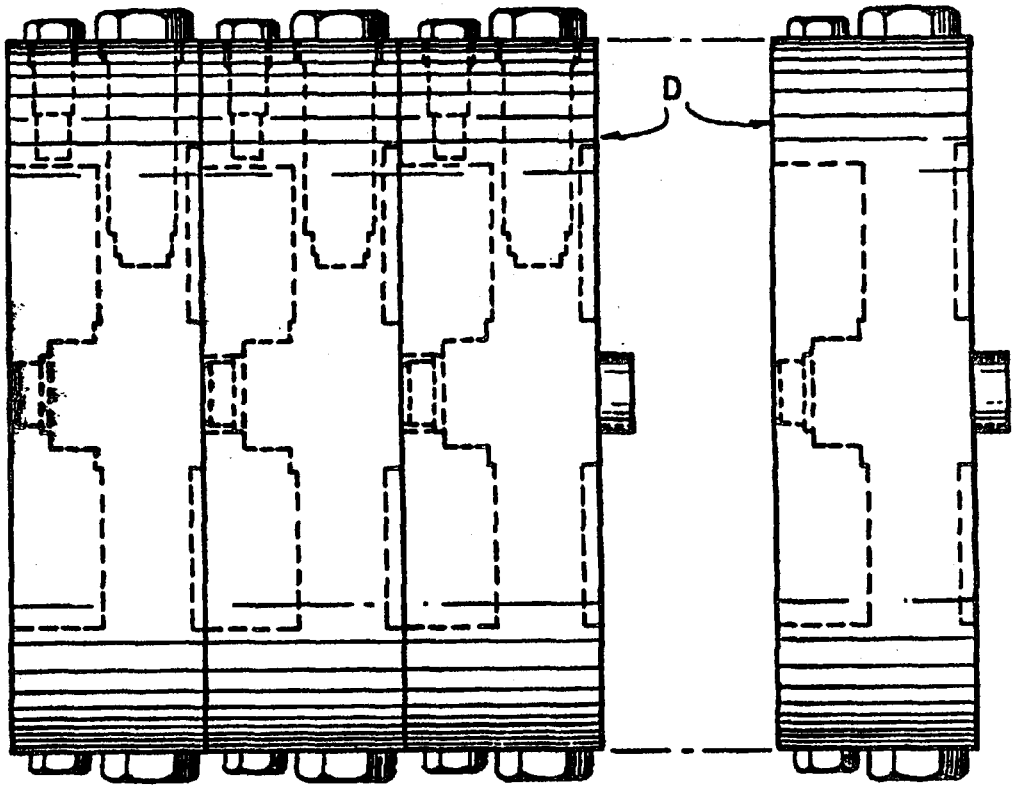

Fig. 5
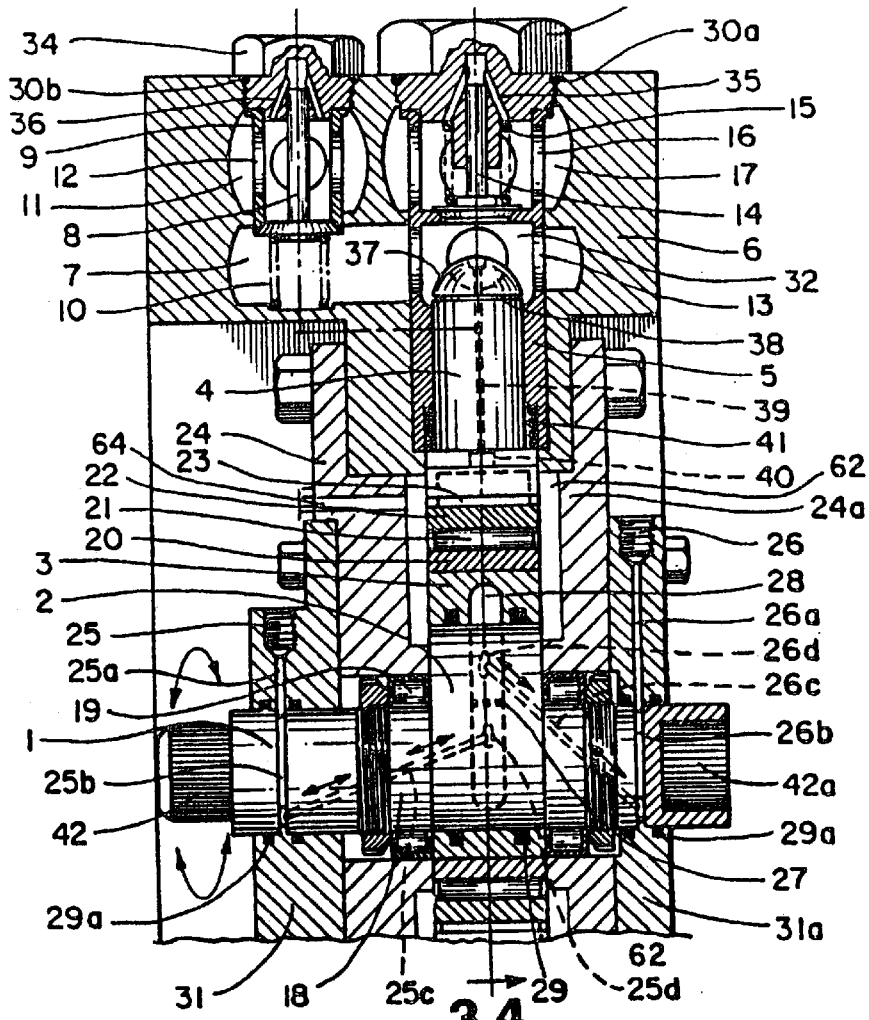
3,4
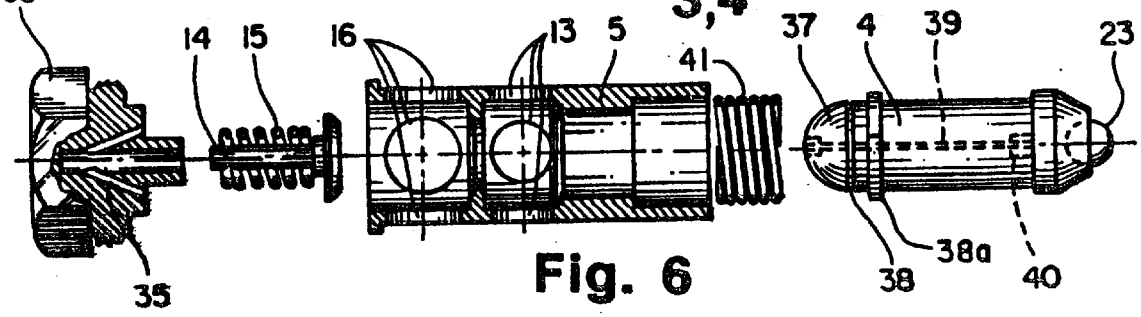
Fig. 6
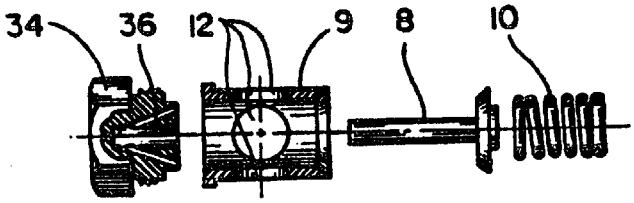
Fig. 7

NEUTRAL

MAX. OFFSET

INTERMEDIATE RETURN

NEUTRAL

MAX. OFFSET

INTERMEDIATE RETURN

NEUTRAL
ROTATIONAL POSITION
(WITHOUT SPLINE KEY)

MAX. OFFSET
FIXED POSITION
(WITH SPLINE KEY)

INTERMEDIATE
FIXED POSITION
(WITH SPLINE KEY)

RADIAL PISTON FLUID MACHINE AND/OR ADJUSTABLE ROTOR

CROSS REFERENCES TO RELATED APPLICATIONS

This application is a division of U.S. application Ser. No. 08/316,119 filed Sep. 30, 1994, and to be issued on Jun. 3, 1997 as U.S. Pat. No. 5,634,777. That application was a continuation in part of U.S. application Ser. No. 07/955,902 filed Jan. 19, 1993, now U.S. Pat. No. 5,377,559 issued Jan. 3, 1995, which was a National Application based on PCT/US91/04575 filed Jun. 26, 1991, which was a continuation in part of U.S. application Ser. No. 07/546,373 filed Jun. 29, 1990, and now abandoned and was also a continuation in part of U.S. application Ser. No. 08/293,793 filed Aug. 22, 1994, now U.S. Pat. No. 5,547,348 issued Aug. 20, 1996, which was a division of the above identified U.S. application Ser. No. 07/955,902.

BACKGROUND OF THE INVENTION

This invention relates to an adjustable rotor and a radial piston machine or device which may utilize an adjustable rotor. The device utilizes either liquid or gaseous fluids or mixtures thereof such as, for example, in internal combustion and steam engines. The machine and rotor are usable as a fluid pump, fluid compressor, fluid motor or engine.

Generally, a radial piston device usable as a fluid pump, compressor, or motor or engine has the following elements: a circular or cylindrical casing with side or end walls and/or covers, a shaft with an eccentric journalled by bearings and extending through the central part of the casing and covers, and a cylinder block which may be combined in one piece with the casing. The cylinder block has a number of cylinders, each fitted with a piston and radially arranged in the cylinder block. During operation as a pump or compressor, rotation of the eccentric shaft drives the pistons to move reciprocatingly in the cylinders. Conversely, if operated as a motor or engine, the pistons impart rotational movement to the eccentric shaft. Contingent on design, the output of a radial piston device can be fixed or variable, and many machines have been developed based on the above mentioned principles.

Certain problems are common with many design configurations of current fluid pumps, compressors and motors and these problems are not necessarily confined to radial piston devices. Such problems are due primarily to heat, sound, and vibratory energy losses caused by the generation of mechanical and fluid friction. For example, in most positive displacement piston devices, friction induced wear or "galling" is common in the shoe area of a piston, as well as uneven cylinder wear due to lateral forces exerted on the lower areas of the cylinder walls. Many devices also contain off-loaded shafts and bearings, unbalanced mechanical and fluid dynamics, pressurized casings, fluid flow restrictions, or moveable masses such as stroke rings, blocks, or casings. These and other structural design deficiencies result in friction losses, increased wear, excessive sound, and reductions in performance, reliability or both while limiting the capability of the machine to endure high pressure surge peaks or achieve sustained higher operating pressures. Additionally, the rotational speed of such devices is also limited, primarily because of mechanical factors and fluid dynamics, and when rotational speed increases beyond the rated revolutions per minute (RPM), efficiency decreases significantly.

Failures of such equipment are often induced by contamination of the fluid medium or high pressure surge peaks caused by misuse, abuse, or improper design of the operating systems. Repair of such equipment usually requires skilled mechanics and special tools and causes costly downtime. Often, complete replacement of a unit is more cost effective than repair because prime components such as casings, blocks, cylinders, and shafts have undergone critical wear and, therefore, have become effectively unserviceable. Additionally, such equipment is often subjected to environmental extremes and operated outside of design or maintenance specifications, decisively increasing wear while diminishing the operating efficiency of the device. A device that would permit convenient on-site replacement of wear-prone parts, particularly while under operation, while also reducing wear on, and maintenance requirements for, prime components would be extremely beneficial, especially in applications where minimization of downtime is critical.

Generally, current fluid mechanical devices have narrow ranges of peak operating efficiency within their rated pressure, volume of flow, and RPM. Serious performance degradation occurs when a device is operated outside of its design parameters, and it is therefore common trade practice to size a fluid pump or similar device to a specific task. In an attempt to satisfy the infinite combination of system design possibilities, there are a multitude of such devices manufactured, with each device having unique size and shape characteristics. If the working pressure, flow rate, or RPM factors change over a wide range, the mean efficiency is dramatically reduced.

Equipment that improves the overall efficiency of fluid-handling or fluid-power systems would also offer substantial technology advancement opportunities. Although it is possible to identify many past improvements to the art of fluid mechanics, modern methods and processes are requiring durability, flexibility, and pressure capabilities that test the limits of existing technology. Also, many present-day pumps, compressors, motors and engines require specialized parts and processes to manufacture, and are therefore not necessarily conducive to mass production and standardization.

System efficiency improvements, particularly in fluid-power applications, are possible by constructing more durable machines capable of tolerating higher standard operating pressure. Higher norms of working pressure provide definite advantages by making it feasible to reduce the size and the weight of hydraulic actuators such as cylinders and motors. This is of particular significance for mobile, aviation, and aerospace hydraulic applications. However, the common mechanical and fluid dynamic problems of existing fluid machines are multiplied with increases in operating pressure. Durability improvements to fluid-power equipment allowing for increased pressure utilizations would effectively allow system design enhancements yielding significant weight reductions.

The limitations of today's fluid machines have also been defined by their individual narrow optimum working ranges and physical characteristics. Each device is intended for a specific application, and the specific internal design and external configuration impose severe limitations on flexibility of use within a system design. A fluid pump, compressor or motor that permits the use of modular interchangeable parts to supply the needs for a broad spectrum of operating requirements would be cost effective for manufacturer, vendor, and end-user.

In addition to modularity of parts, system efficiencies could be further enhanced by modularity of shape. Although some current machines couple units on the same shaft, a long axis of drive normally requires modifications to the device itself or additional mounting or support means. The ability to couple individual units closely on one drive shaft without equipment modifications, excessive overall shaft length, and undue torsional shaft dynamics would exhibit a distinct advantage. These advantages are useful for pumps and compressors in powered devices and for combustion and other types of engines and fluid power motors in powering devices.

For instance, mobile heavy equipment industries commonly use a massive gear casing that houses complex gear trains for the purpose of providing multiple power take-off shafts to power the number of hydraulic pumps necessary for a single piece of equipment. Often, this component is a casing assembly designed for use in several lines or types of equipment, and in each specific application certain shafts and associated gears may go unused due to configuration and design mismatch, even though these gear trains consume energy in full-time operation and add to the cost of manufacturing the assembly. These large gear casings could be eliminated or down-sized by an improved ability to stack multiple units for separate fluid-power circuits on one primary drive shaft. Other examples of fluid-handling applications that would benefit from such improved stacking of units include fluid dispensing and fluid metering needs of the agricultural, petroleum/chemical, and food processing industries. Standby or extra functional units for safety, emergency, or other utilizations could also be more easily provided.

It has long been recognized that the ability to supply the exact pressure and volume of flow requirements for a system by controlling the output of a pump or compressor, independent of the input RPM while under operating load conditions, substantially reduces overall energy consumption and simplifies the system design. This capability is called continuously-variable dynamic control of the pumping source and improvements of this feature would substantially increase system efficiency.

Fixed output high-pressure or low-pressure pumps and compressors are very inefficient because they are usually sized to meet maximum load specifications and require sufficient RPM to provide a constant over-production of output. For example, normally the downstream actuators used in fluid-power systems do not require the maximum output that is generated, and subsequent control of excess output is commonly accomplished by additional downstream valves and components that divert excess volume and/or pressure to a reservoir, the unused output energy thus dissipating in the form of heat and often requiring supplemental cooling components.

Refrigeration and air-conditioning equipment and some hydraulic circuits, on the other hand, have a demand that is often satisfied by an intermittent fixed maximum output. In such cases control is usually accomplished by cycling, the on-again/off-again control of a fixed output compressor or pump by the use of a clutch mechanism, which is both inefficient and mechanically detrimental.

Traditional methodologies of achieving variable dynamic output control of a positive displacement source have taken exotic directions as exhibited by complicated vane, radial, and axial designs. Common fluid mechanics problems include the slow response of moveable masses such as stroke-rings or casings, sealing difficulties with pressurized casings, friction wear associated with off-loaded shafts and bearings, galling of piston shoe areas, and excessive sound. Current variable output, dynamically controlled pumping options are costly to manufacture and of questionable performance and durability, even when operated within their narrow design ranges, and particularly when dealing with high pressure applications. The adjustable rotor of the present invention provides solutions for such problems.

Simple powering devices such as combustion engines generally have fluctuating drive shaft RPM, and drive sources such as electric motors usually have more or less constant RPM but also often have continuously variable output requirements. In addition to the complex internal mechanical designs presently available to supply variable dynamic output control of the pumping source, other equally extensive supplementary electrical and mechanical systems have more recently been developed to externally control the input drive shaft RPM of a pump in an attempt to improve overall fluid mechanics system efficiency. In summary, these factors indicate the need to develop improved, simplified, and affordable variable dynamic control of fluid machines.

SUMMARY OF INVENTION

An adjustable rotor and a modular radial piston fluid machine are provided which reduce greatly and can virtually eliminate off-loaded forces on shafts and bearings, minimize shaft torsion, and include various means and options for reducing fluid and mechanical friction yielding high peak operating mechanical and volumetric efficiency. These improvements also enhance reliability, durability, maintainability, and add flexibility by expanding the peak operating efficiency range of the device. Manufacturing and inventory economies are possible, and fluid mechanics system efficiency improvements are offered by a modular stacking capability, increased pressure capability, and a variety of affordable output control options ranging from fixed output to continuously-variable, dynamically controlled output.

Further improvements disclosed in this continuation in part application enhance both the performance of the systems and the manufacturability of the systems. While the specific embodiments disclosed are configured particularly for high pressure applications, they may be adapted for other applications.

These improvements contribute to noise reduction, greater power density, smaller size and adjustability of valve timing in a radial piston device. Improvements are also disclosed in rotary valve design, piston design, especially for high pressure uses, contact of piston with eccentric, and lubrication and pump sealing means. The improvements also provide means for pre-programmed internal dynamic rotor control, dynamic rotor control by routing control fluid from a source external to the rotor, and a rotor which is adjustable using multiple vanes.

The improvements favorably affect manufacturability by using individual parts to perform multiple functions thus reducing the number of parts in each unit, increasing design symmetry and modularity to reduce the total number of different parts to be manufactured, and designing the components to be suitable for various forming or molding processes, including die casting, extrusion, powder metal etc.

DESCRIPTION OF THE DRAWINGS

FIG. 1 is a perspective view of a radial piston fluid machine usable as a fluid pump, compressor, motor or engine and exterior features of the present invention;

FIG. 2 is a side elevation of a series of radial piston devices as seen in FIG. 1 but here shown as being mounted in axial stacked relation;

FIG. 5 is an enlarged fragmentary vertical section of the present invention.

FIG. 6 is an enlarged partially sectioned exploded view of a piston cartridge assembly including a piston and component parts;

FIG. 7 is an enlarged exploded view of an inlet cartridge assembly and component parts;

FIG. 34 is a cross section of the improved radial piston fluid machine taken through the axis of the drive shaft with some elements in phantom.

FIG. 35 is a cross section of the improved radial piston fluid machine shown in FIG. 34 as viewed on line 35—35 in FIG. 34 with some elements in phantom.

FIG. 36 is a diagrammatic side view and a cross section of the carriage cover plate shown in FIG. 34 and associated structures.

FIG. 37 is a diagrammatic side view of the valve plate shown in FIG. 34.

FIG. 38 shows cross sections of the timing case shown in FIG. 34 from the right and left sides thereof as shown in FIG. 34 and the interconnection between the two sides thereof.

FIG. 39 is a diagrammatic side view of the rotor disk shown in FIG. 34.

FIG. 40 is a cross sectional view of the adjustable rotor shown in FIG. 35 in a different position.

FIG. 41 is a diagrammatic view of the geometry of the timing mechanism shown in FIGS. 34 and 35.

FIG. 42 shows the geometry of the secondary eccentric shown in FIG. 35.

FIG. 43 shows the geometry of the timing link shown in FIGS. 34 and 35.

FIG. 44 shows the geometry of the valve timing operation using the apparatus shown in FIGS. 34–43.

FIG. 45 shows eccentric mechanisms according to FIGS. 34–44 using bonded elastomers.

DETAILED DESCRIPTION OF THE INVENTION

In order to assist in a fuller understanding of the above and other aspects of the present invention, the embodiments will now be described, by way of example only, with reference to the accompanying drawings as a manually adjustable fixed displacement; a fixed displacement, pressure compensated; and a dynamically-controlled, continuously-variable radial piston machine. The description will, for the most part, describe the machine as a pump or compressor. However, those skilled in the art will readily perceive the utility of the machine as a motor or engine where power input and output are interchanged. With the addition of a control device for the timed sequential opening and closing of valves relative to positions of eccentrics and pistons the machine will function as a motor or engine.

Fluid Mechanics

Figure 3:
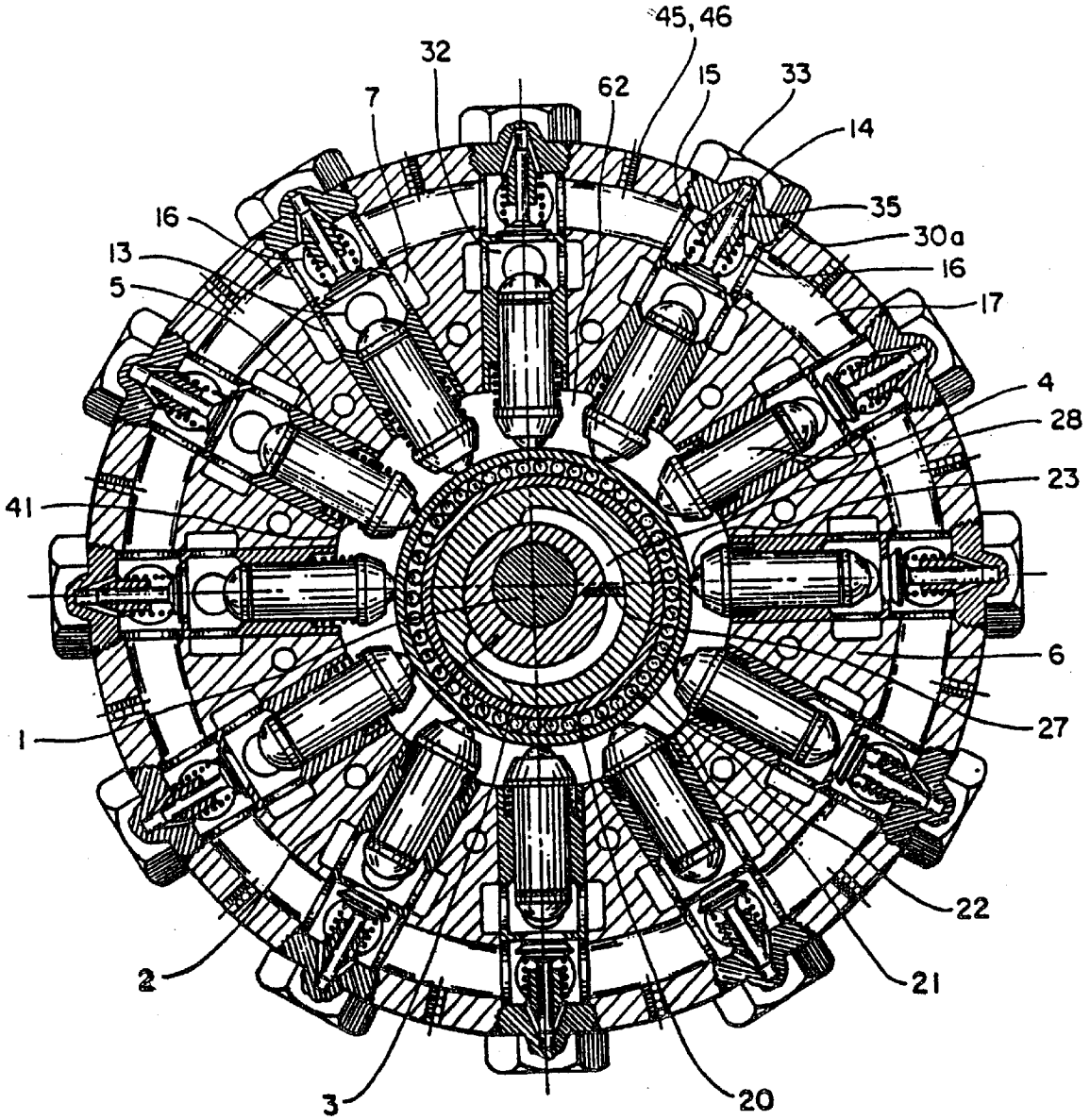
FIG. 3 is an enlarged fragmentary vertical section through the radial piston device shown in FIG. 1 with certain components being illustrated in elevation as viewed on the line 3—3, shown in FIG. 5 looking in the direction indicated by the arrows.
Figure 4:
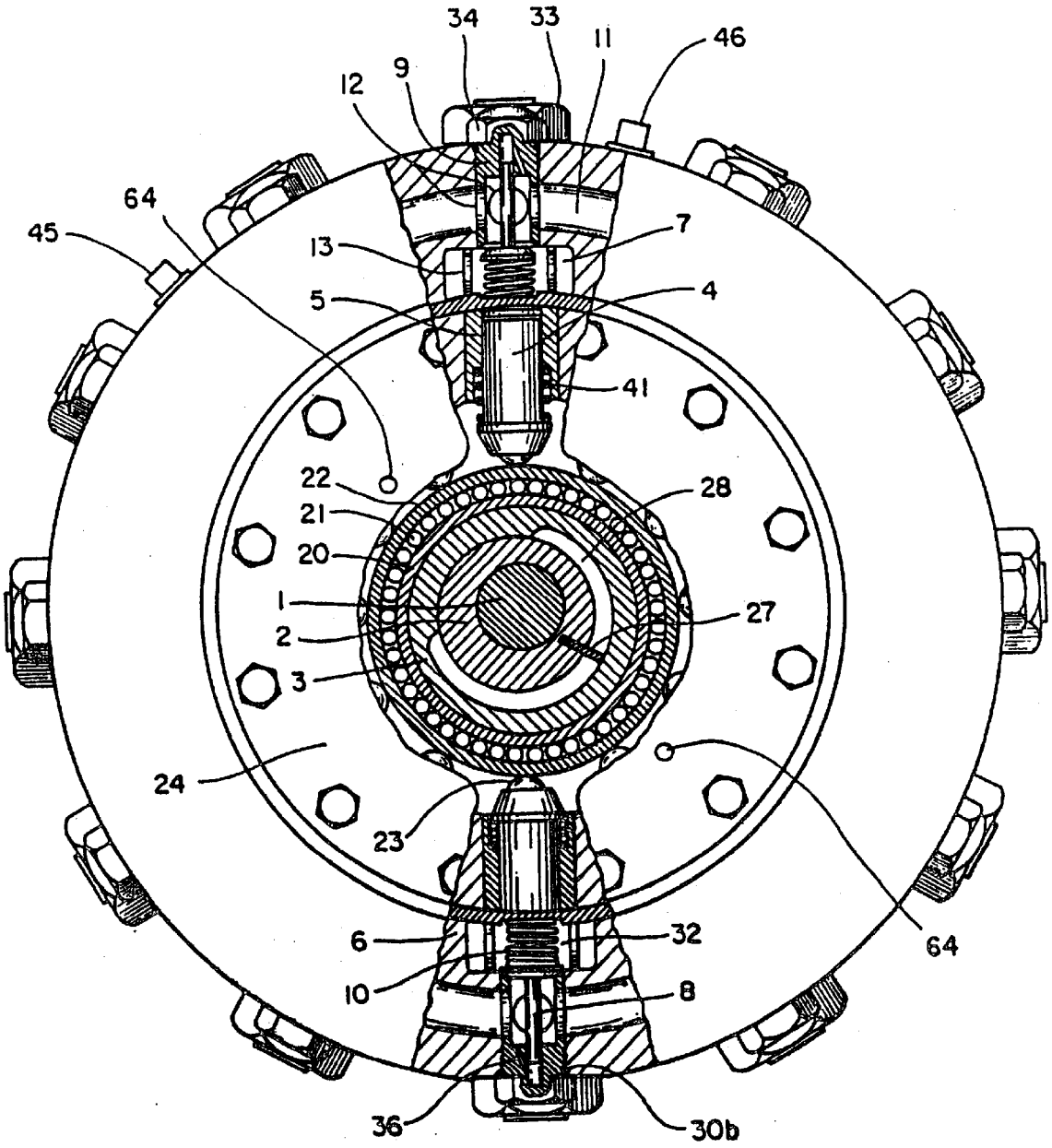
FIG. 4 is an enlarged fragmentary side or end elevation of a radial piston device with certain parts being broken away and exposed as viewed on the line 4—4, shown in FIG. 5 looking in the direction indicated by the arrows.
Figure 8:
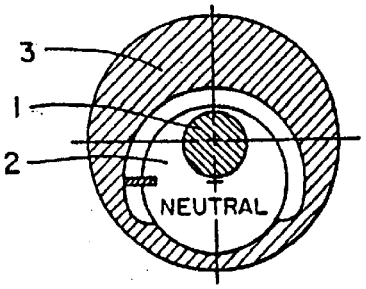
FIGS. 8–14 are a series of vertical cross sections of an eccentric rotor assembly showing a secondary eccentric ring in different positions relative to the drive shaft and primary eccentric illustrating how the rotational relation of the primary eccentric and the secondary eccentric achieves variable offset.
Figure 9:
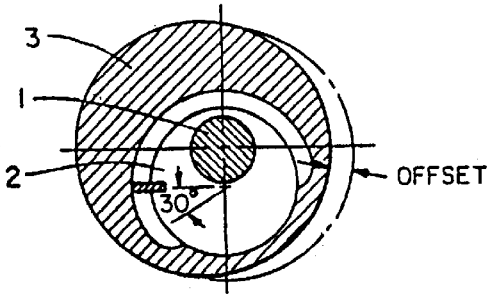
Figure 10:
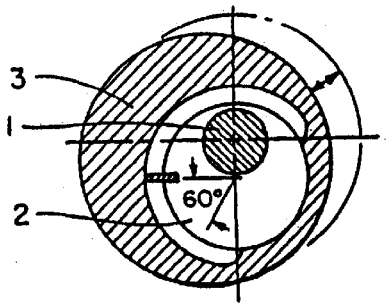
Figure 11:
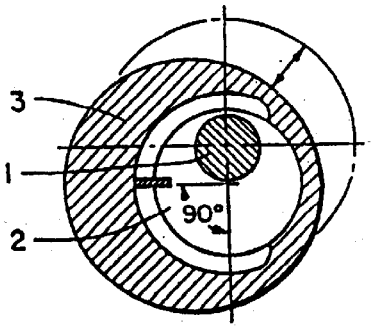
Figure 12:
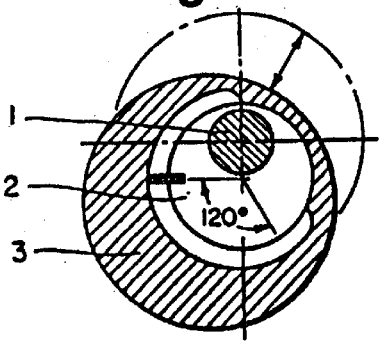
Figure 13:
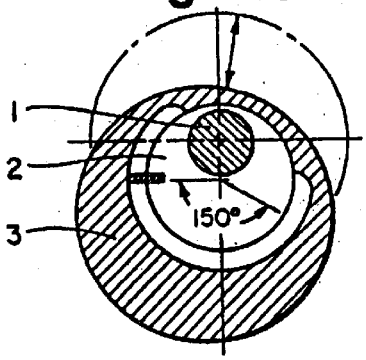
Figure 14:
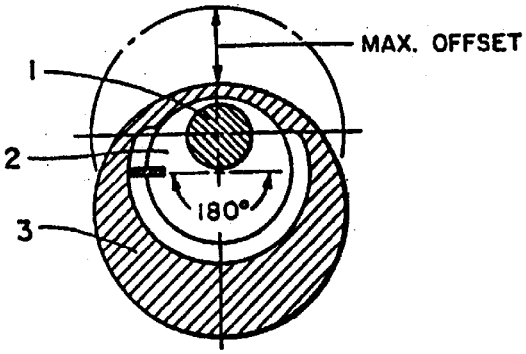

A radial piston device D according to the present invention is shown generally in FIG. 1 and FIG. 2. Referring more specifically to FIGS. 3, 4 and 5, the device comprises a central shaft 1 on which a primary eccentric 2 is affixed or machined in one piece. A secondary eccentric ring 3 surrounds shaft 1 and primary eccentric 2 and, in operation, is effectively locked to primary eccentric 2. Rotation of shaft 1 causes a peripheral offset face of primary eccentric 2 to rotate, thereby effectively transferring driving vector forces through eccentric ring 3 to a fluid pumping piston 4, confined within a piston cartridge cylinder 5 (hereafter referred to as piston cartridge 5) which is in turn inserted into a radially aligned bore within a circular or cylindrical cylinder block 6.

Intake (low pressure inlet or suction) valves 8 shown in detail in FIG. 7 and exhaust (high pressure output) valves 14 shown in detail in FIG. 6 to control fluid movement are both ported by a stem poppet as illustrated in FIGS. 3 through 7. The valves 8 or 14 could also be ball-check, or other conventional valve designs such as reed, cam activated rotary, or electronic solenoid. The intake valve 8 is shown confined within an inlet valve cartridge 9 (hereafter referred to as inlet cartridge 9) and within a valve stem guideway in a threaded cap 34. The exhaust valve 14 is shown confined within piston cartridge 5 and within a valve stem guideway in a threaded cap 33 although both valves 8 and 14 could be confined entirely within a single piston cartridge assembly 5. Various lubrication options for the machine are provided. A fluid sump cavity 62 in the shape of an annulus surrounding shaft 1 is supplied and exhausted through ducts 64. Roller bearing assembly 19 and secondary eccentric bearing assembly 20, 21 and 22, pistons 4, as well as the surfaces between eccentric 2 and eccentric 3, may be lubricated from the sump cavity 62 or may be of the low-friction type, the self-lubricated type or the sealed lubrication type. Lubrication may also be provided by the pumped fluid.

On the downward stroke of piston 4, assisted by a piston spring 41 and consequential to the rotation of shaft 1 and an offset moment of eccentricity, fluid enters the device through external inlet (suction) port 45 (FIGS. 1, 3, 4) into a low pressure fluid distribution system comprising an annular (suction) manifold cavity 11 and the inlet valve cartridge 9. Intake valve 8 opens in opposition to an intake valve spring 10 allowing fluid to enter a common fluid chamber 7 from an annular low pressure (suction) manifold cavity 11 through inlet ports 12 in inlet cartridge 9.

Conversely, when an offset moment of eccentricity rotates with shaft 1 and causes piston 4 to rise in opposition to piston spring 41 while being confined within the piston cartridge 5, pressure is exerted on the common fluid-filled chamber 7 through cylinder intake ports 13 in piston cartridge 5, causing intake valve 8 to close with the assistance of valve spring 10. At the same time this fluid pressure in common fluid chamber 7 causes the exhaust valve 14 to open in opposition to an exhaust valve spring 15, the fluid thereby exiting through exhaust ports 16 in piston cartridge 5, into an annular (exhaust) manifold cavity 17 which together with the piston cartridge 5, comprise a high pressure fluid distribution system. Fluid is expelled from the unit through high pressure external outlet (exhaust) port 46 (FIGS. 1, 3, 4).

Fixed and Variable Displacement:

According to the present invention as illustrated in detail in FIGS. 8–14, in addition to the fixed offset of the primary eccentric 2, an adjustable cam or rotor assembly is formed when the secondary fitted eccentric ring 3 is radially combined or effectively locked with the primary eccentric 2, thus achieving an adjustable offset moment allowing rotation of the rotor in either direction. As noted above, primary eccentric 2 is mechanically fixed or integrally constructed as part of shaft 1, and is combined with secondary eccentric ring 3. The secondary eccentric ring 3, as shown in FIGS. 26–29, is adjustably fixed in a given relative rotational position by a spline key 43 and spline slot groove detents 44*a*, 44*b*; or may be adjustably fixed and seated by other mechanical means around the primary eccentric 2 in order to achieve an adjustably fixed stroke.

In contrast, as shown in FIGS. 15–20, the rotational relationship between these two eccentrics may be slideably arranged and fitted. Means are provided to allow the introduction of pressurized fluid into a cavity or space 28 between the two eccentrics so that full hydraulic locking and control may be achieved with incompressible fluids. Shaft 1 and the primary eccentric 2 are effectively adjoined and locked with the secondary eccentric ring 3, and the entire rotor assembly is free to rotate in either direction with the shaft journal area 18 contacting roller bearing assembly 19. The rotor assembly and shaft 1 are supported and housed in casing 24, 24*a* (which may be fabricated in one part with block 6 or cover plate 31 and 31*a*, in which case the term carriage plate is commonly used).

The rotation of the shaft 1 from an external drive source causes subsequent rotation of the secondary eccentric ring 3 due to the fact that the eccentric rotor assembly is hydraulically or mechanically locked. This force is thereby transferred through an inner race 20, to a series of anti-friction bearings 21, to an outer race 22, to a roller bearing 23 fitted captively in the bottom of each piston 4.

The relative rotation of the secondary eccentric ring 3 about the primary eccentric 2 changes the offset of the outermost rise of the secondary eccentric ring 3. This function allows for the selective dimensional rise or stroke of the pistons and, thus, the consequential adjustable volumetric displacement of incompressible fluids or adjustable compression ratio for compressible fluids.

Figure 15:
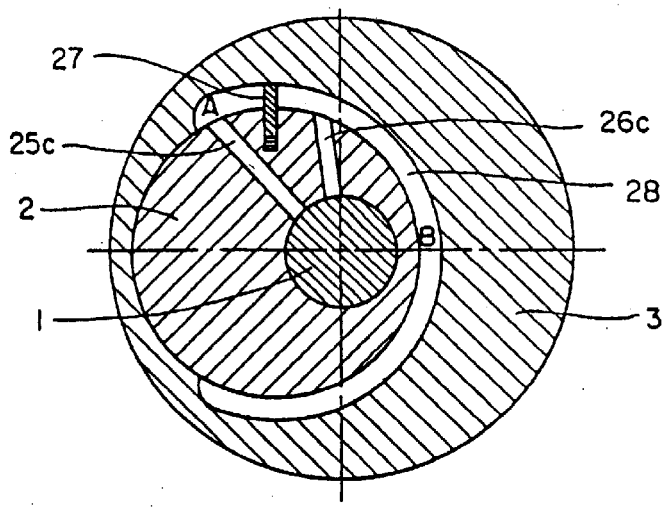
FIG. 15 is an enlarged vertical section showing the fluid controlled variable eccentric rotor assembly of the radial piston device in neutral position.
Figure 16:
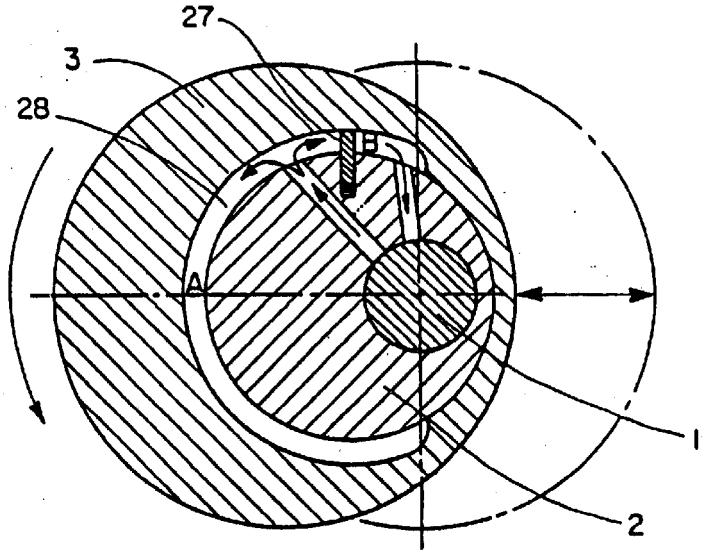
FIG. 16 is an enlarged vertical section similar to FIG. 15 showing the fluid control pressure actuation of the rotor assembly to obtain a maximum offset (stroke) position.
Figure 17:
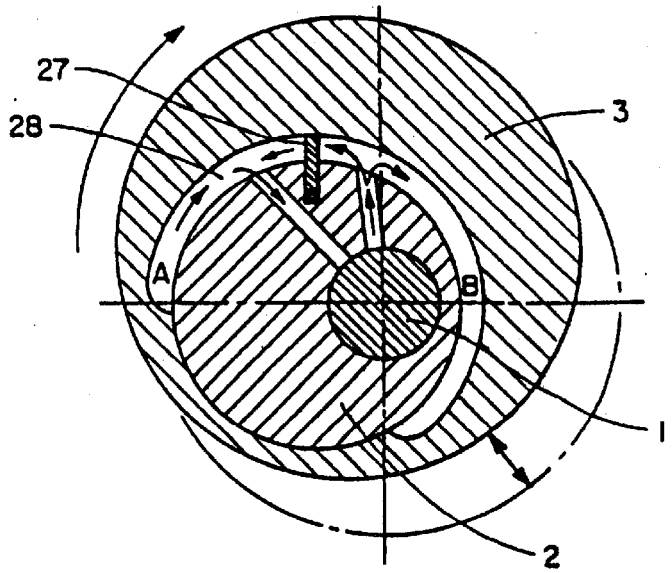
FIG. 17 is another vertical section of the drive shaft and eccentric rotor assembly showing the fluid control pressure actuation to obtain rotation of the secondary eccentric from maximum offset to an intermediate return or partial stroke position.

As shown in FIGS. 15–20, the rotational control and locking of the secondary eccentric ring 3, when slideably fitted about the primary eccentric 2, is accomplished by the use of fluid control pressure introduced by a separate (pilot) pressure pumping source, or alternatively supplied by the pumped fluid output (system pressure). As further illustrated in FIG. 5, this control pressure is separated into two opposing differential fluid pressure control circuits that are connected to cover plates 31 and 31*a* using two threaded holes 25 and 26 following the control fluid pressure duct passages 25*a* and 26*a*, and allowing fluid to fill shaft annular fluid grooves 25*b* and 26*b*, respectively. The opposing, differential control pressure fluid circuits are further directed through the adjacent journal and primary eccentric areas of the shaft 1 utilizing fluid ducts 25*c* and 26*c* and terminating at points 25*d* and 26*d* respectively at each side of a control vane 27. As shown in FIGS. 15–17, the control vane is radially located on the circumference of primary eccentric 2. Thus, the differential fluid pressure control circuits are directed into the internal vane recess groove cavity 28, each fluid control circuit acting in vectored opposition on control vane 27 and on the opposing internal reactive surfaces of primary eccentric 2 and secondary eccentric 3.

Figure 18:
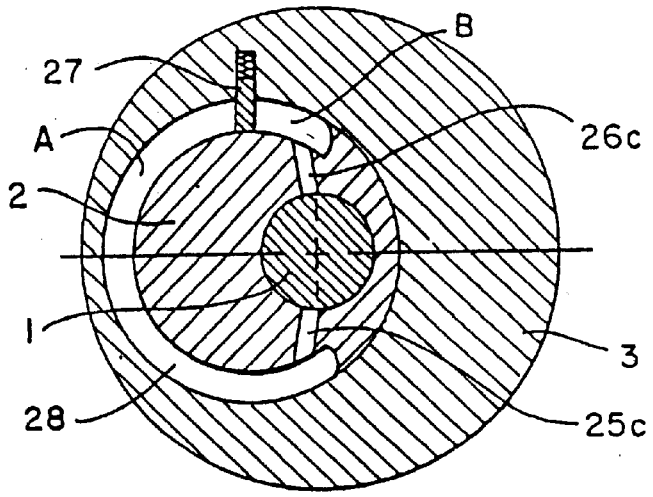
FIGS. 18–20 are enlarged vertical sections analogous to FIGS. 15–17 showing alternative arrangements of control components.
Figure 19:
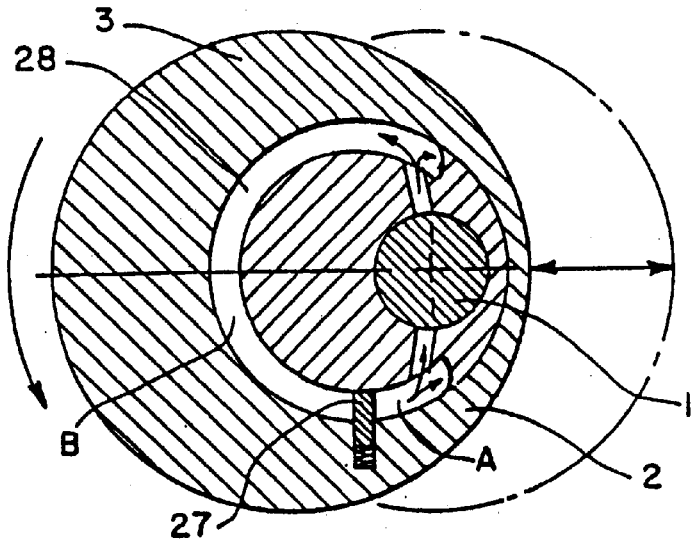
Figure 20:
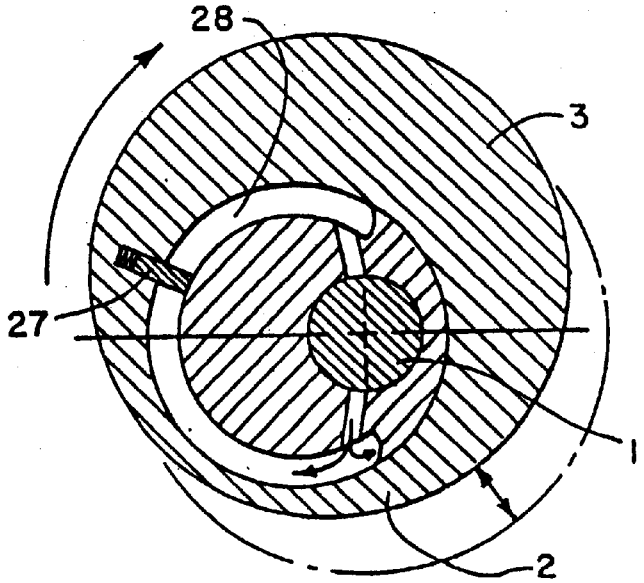

As shown in FIGS. 18–20, the geometric relationship of the control vane 27 and the recessed vane groove 28 may be reversed allowing the control vane 27 to be located in the secondary eccentric ring 3 and the recessed vane groove 28 in the primary eccentric 2.

When fluid pressure is used, the control vane 27 is radially spring loaded (or, alternatively, may be loaded hydraulically, magnetically, etc.), causing a sliding fitted sealing contact into vane recess groove 28. This effectively separates the vane recess groove 28 to form two distinct expandable and collapsible chambers A and B. These opposing differential fluid control pressures are communicated through this circuitry into chambers A and B of the vane recess groove 28 and, when appropriately regulated, resultant pressure differentials in chambers A and B cause a subsequent rotation of the secondary eccentric ring 3 about primary eccentric 2 as the relative size of chambers A and B increases and decreases accordingly.

This relative rotation of the secondary eccentric ring 3 about the primary eccentric 2 changes the offset distance of the outermost rise of the secondary eccentric ring 3, thus achieving controllable variable volumetric displacement or compression ratio by affecting piston stroke. Seals 29 are located between the primary and secondary eccentrics and seals 29*a* are located in the cover plates 31, 31*a* and seals 30*a*, 30*b* are located around each threaded cap 33 and 34 to control fluid leakage.

The actuation of this control function may be accomplished by manually directing the increase and decrease of demand for each fluid pressure control circuit through proper manually-actuated valving, or optionally by utilizing appropriate automatic, load-sensing control valving mechanisms. The opposing, differential, control pressures introduced into chambers A and B of the vane recess groove 28, use the manually-actuated or automatically load-sensed and supplied increase and decrease of fluid pressure on opposing sides of control vane 27, thus affecting the direction of the rotation of the secondary eccentric ring 3 about the primary eccentric 2 as shown in FIGS. 16 and 17. Opposing, differential control pressures of fluid pressure in chambers A and B of the vane recess groove 28, against vane 27 and opposing reactive surfaces of the eccentrics 2 and 3, determine the relative rotational position of the eccentrics with each other at any given moment, and also effectively hydraulically lock the eccentrics 2 and 3 in this position. This hydraulic locking function allows the necessary total rotor assembly rotation.

In defining the factors related to the design and function of control vane 27, torque may be expressed as:

$$T = \frac{\text{HP}}{\text{RPM}} \times 5252$$

Where: T=Torque

HP=Horsepower

RPM=Revolution Per Minute

5252=Unit Conversion Factor

The torque requirements to lock control vane 27 may be stated as:

$$T=(P\times A)R$$

Where: T=Torque

P=Pressure Difference Across the Vane

A=Vane Area

R=Radius to Vane Centroid

Horsepower is related to displacement as follows:

HP~P X Flow Rate and

Flow Rate~(D) X RPM

Where: D=Volumetric Displacement Per Revolution

From the following relationship it can be seen that the product of the control vane area and radius to the vane centroid is directly proportional to the pump volumetric displacement.

$$AR = \frac{T}{P} \sim \frac{\text{HP}}{\text{RPM}} \times \frac{1}{P} \sim \frac{(P)(D)(\text{RPM})}{(\text{RPM})(\text{P})} \sim D$$

Therefore, when utilizing system pressure as the controlling pressure, design requirements of the area of control vane 27 are dependent on fluid displacement volume and independent of torque and pressure factors. Pressure and torque requirements on control vane 27 parallel system pressure. This relationship allows starting under load; that is, pressures required to properly actuate and control this device internally exactly track the demand pressure. Another advantage is that the control mechanism to achieve adjustable output is affected only by applied torque and need not carry full compressive load.

Figure 21:
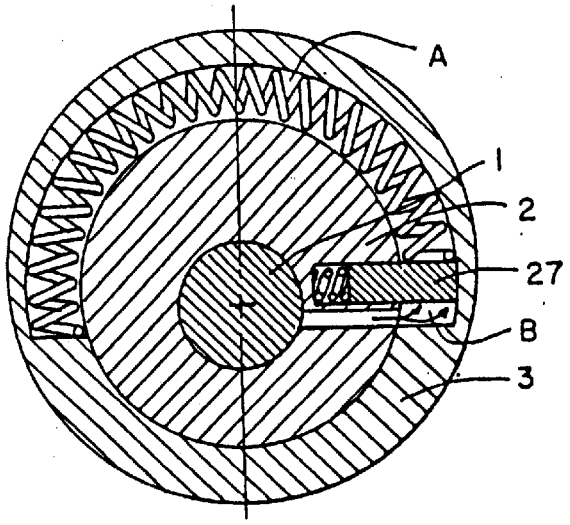
FIGS. 21–23 are enlarged vertical sections showing alternative control means.

A further modification of this variable output control, as shown in FIG. 21, includes elastic loading, as shown in cavity A, of one side of control vane 27 against output pressure in cavity B, providing self-compensating output pressure regulation. Various means of elastic loading include, but are not limited to, springs, gas or liquid compression, elastomers, etc. This feature permits control of output through nonlinear design of the opposing loading force, in effect allowing custom tailoring of the output curve.

Figure 22:
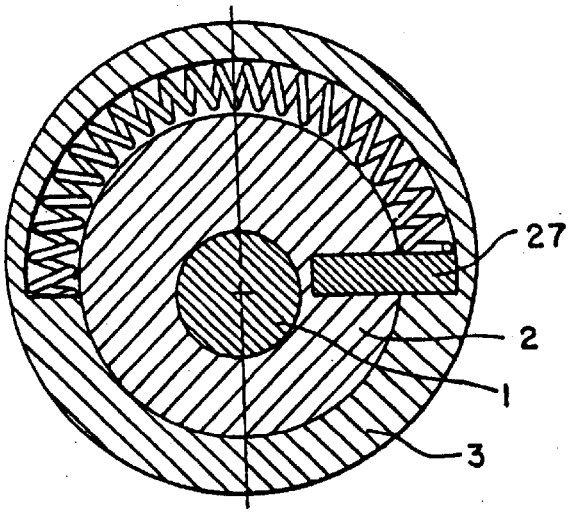
Figure 23:
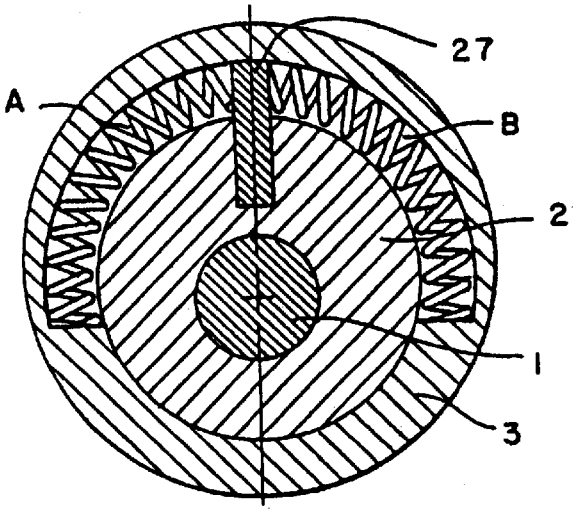
Figure 24:
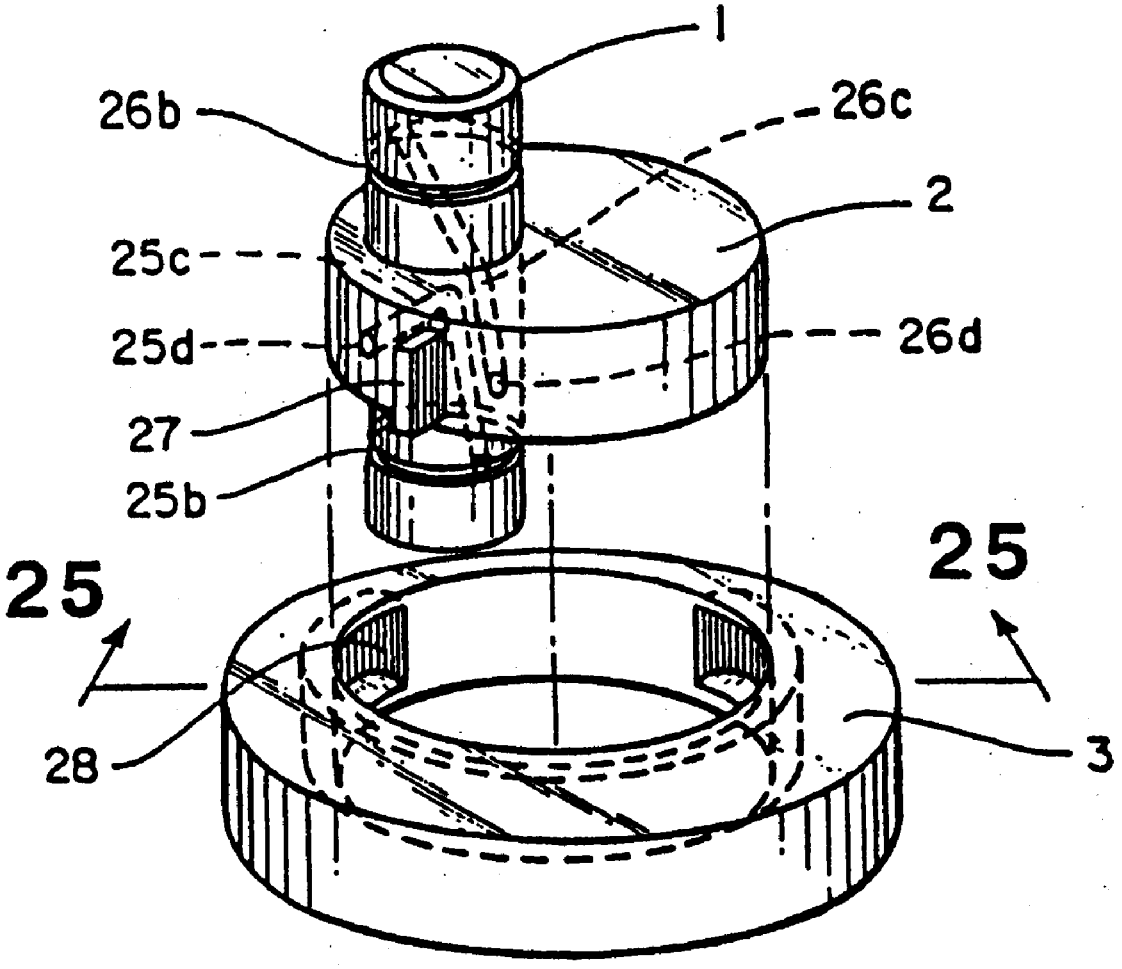
FIG. 24 is an exploded perspective view illustrating the relationship of the rotor assembly components and the fluid control pressure grooves and ducts to obtain fluid controlled variable displacement.
Figure 25:
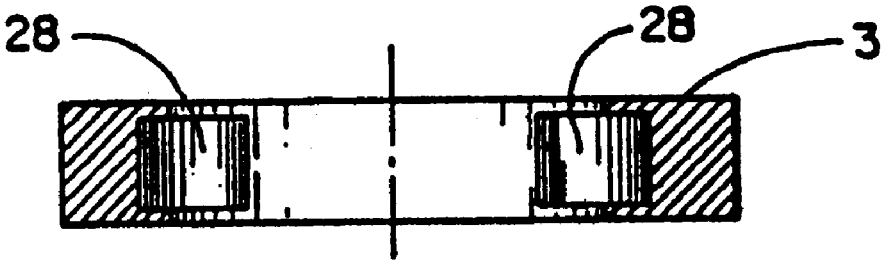
FIG. 25 is a cross-sectional view of the eccentric rotor assembly taken on the line 25—25 looking in the direction indicated by the arrow as seen in FIG. 24.
Figure 26:
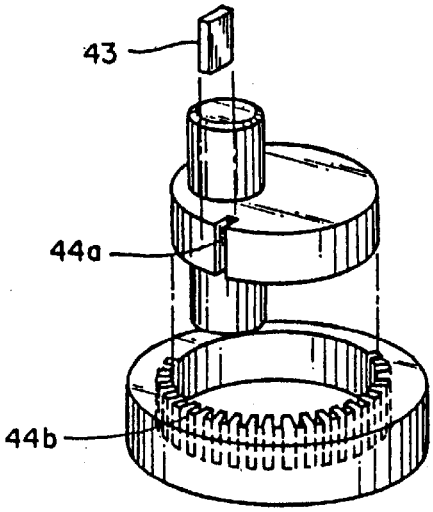
FIG. 26 is an exploded perspective view illustrating the relationship of the rotor assembly components and a means of adjustably fixing the rotational relationship of the eccentrics utilizing a spline key to obtain an adjustable fixed displacement.
Figure 27:
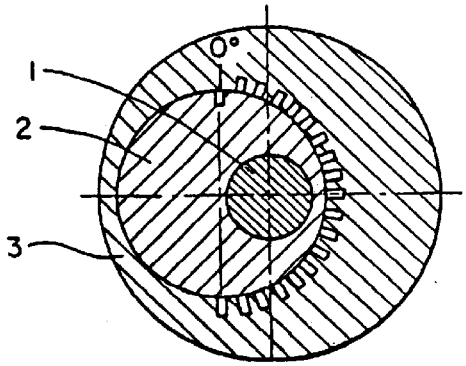
FIG. 27 is an enlarged vertical section showing the adjustable fixed eccentric rotor assembly in a neutral rotational position.
Figure 28:
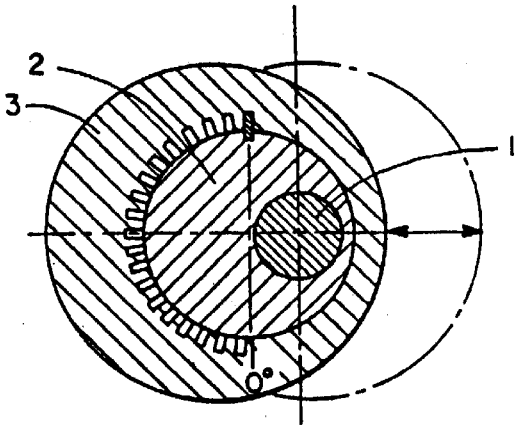
FIG. 28 is an enlarged vertical section similar to FIG. 27 only showing the use of a splined detent of the rotor assembly to obtain fixed maximum displacement (full stroke)
Figure 29:
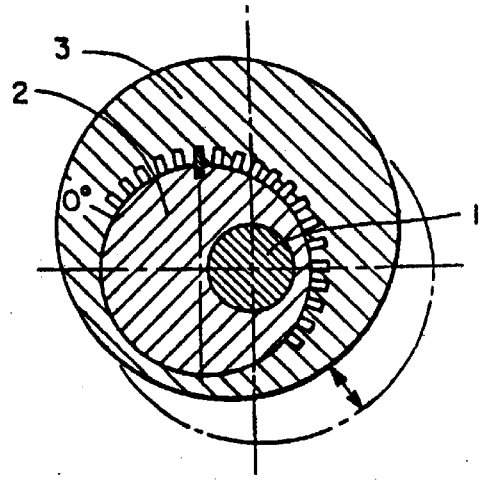
FIG. 29 is another vertical section of the drive shaft and eccentric rotor assembly showing a rotated splined detent position to obtain an intermediate fixed displacement (partial stroke)

Additional variations, as shown in FIGS. 22 and 23, of compensated, fixed output configurations include elastic loading of one or both sides of the control vane 27 with no hydraulic control pressure regulation. This design allows soft-start, surge protection and other beneficial options of output tailoring and does not require seals to retain fluid pressure.

Modular Piston Cartridge Assembly and Modular Inlet Valve Cartridge Assembly:

Referring to FIG. 6, the piston cartridge 5 is modular in nature and is constructed so that the external dimensions of the piston cartridge are matched to fit standard bore sizes of cylinder block 6. However, as shown schematically in FIG. 30, piston cartridges 5 are manufactured in various increments of interior cylinder sizes to be matched with larger and/or smaller diameter pistons, springs, ports, and valves. When a user selectively chooses an optional size of piston cartridge assembly, including the piston and its component parts, a change is dictated in the volumetric output of the device D allowing the device D to serve a wide range of displacement sizing options and utilizations and a broad spectrum of materials engineering options. Exterior access and ease of removal of these components which are subject to the greatest wear also simplify maintenance requirements and reduce associated costs.

As shown in FIG. 5, the piston cartridge 5 is constructed with piston cylinder intake ports 13 allowing fluid to fill a piston chamber 32 above the piston head. Exhaust ports 16 of piston cartridge 5 allow fluid to exit into the annular exhaust manifold 17 which, together with piston cartridge 5, comprise the high pressure distribution system. Threaded caps 33 and 34 seal the piston cartridge 5 and the inlet cartridge 9 into the cylinder block 6 and serve as valve guideways for the exhaust and intake valves 14 and 8 respectively. Holes 35 and 36 respectively in cartridge caps 33 and 34 nullify valve stem suction.

The inlet valve cartridge 9 is also modular and constructed so that the external dimensions of the inlet valve cartridge are matched to fit standard bore sizes of cylinder block 6, and is manufactured in various incremental sizes of valves, springs, and ports to be matched for use with specific piston cartridge unit assemblies. Of course, the inlet valve may also be incorporated within the piston cartridge as a combined unit.

The piston 4 is constructed with a dome-shaped top 37 and is confined within the piston cartridge cylinder 5. When using a lubricating liquid fluid medium, cylinder wall lubrication is accomplished utilizing lubricating groove 38 and excess leakage is minimized with compressible piston ring 38*a*. Likewise, fluid duct 39 provides lubricating liquid fluid communication between the piston chamber 32 and a piston bearing 23 for positive hydrostatic lubrication thereof. A liquid fluid metering and a check valve orifice insert 40 is provided in the piston 4 and is aligned with a fluid duct 39, through the piston 4, providing control of the fluid lubrication to roller bearing 23. The piston spring 41 is interposed between the piston cartridge 5 and the piston 4 to maintain contact with the outer bearing race 22.

Segmenting the Device

Figure 30:
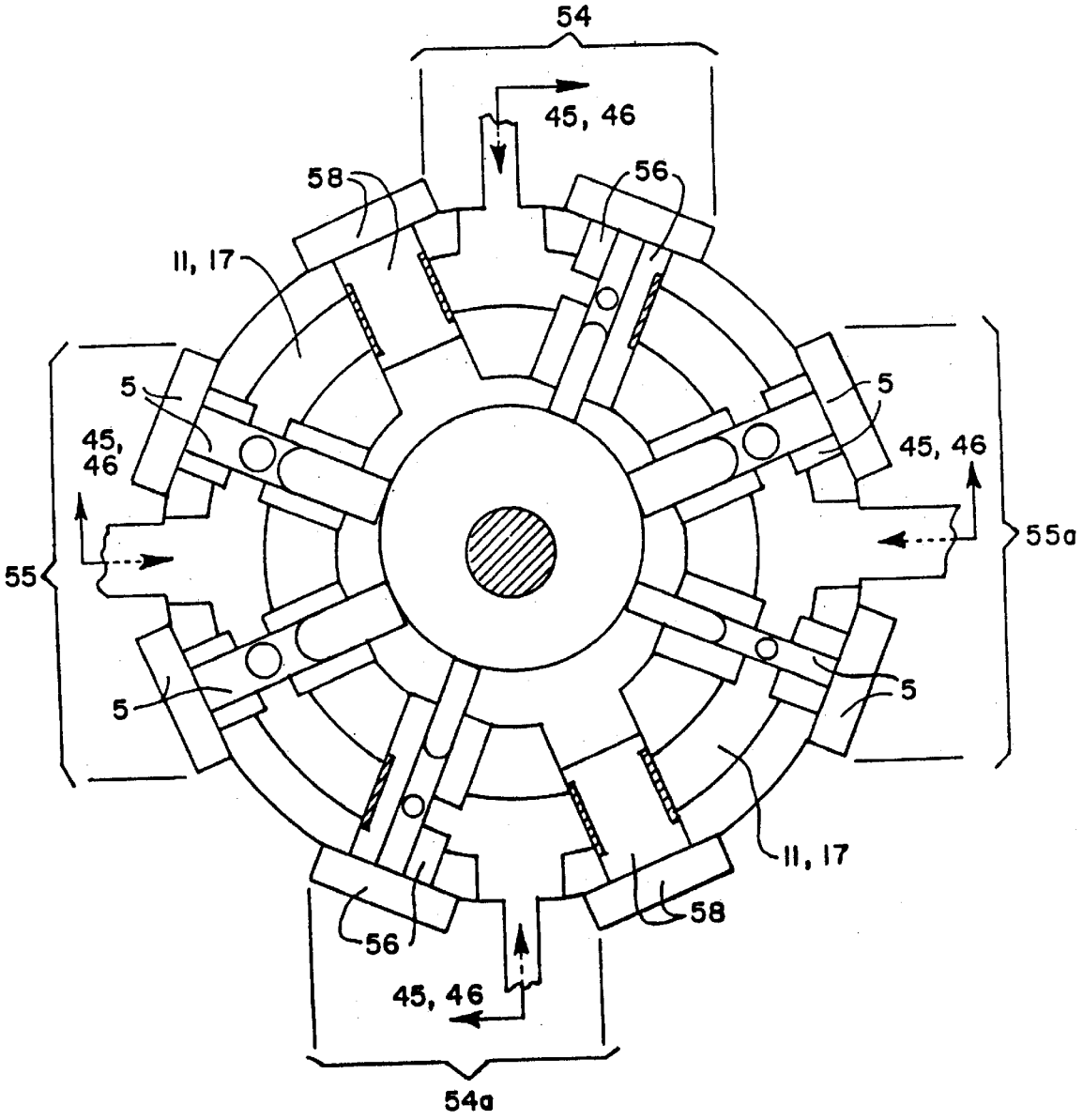
FIG. 30 is a schematic diagram of the machine showing arrangements for segmenting a single unit for various purposes.
Figure 31:
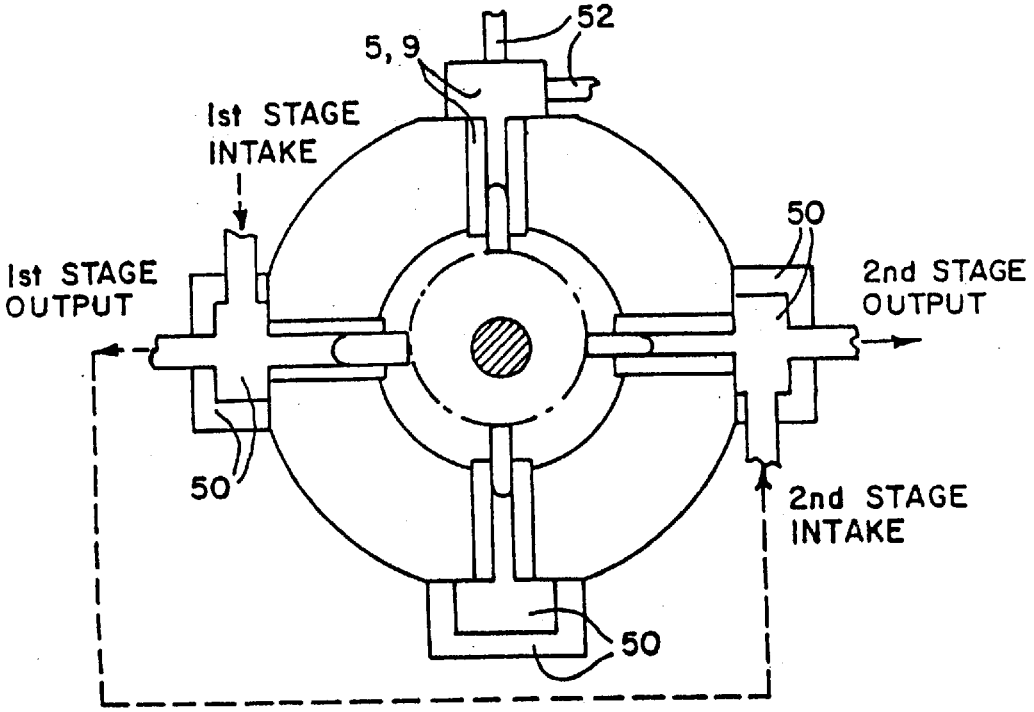
FIG. 31 is a schematic diagram of the machine showing various external connections.

As shown schematically in FIGS. 30 and 31, a segmenting feature allows one device to supply separate fluid circuits, fixed in output according to the selection of piston cartridge displacements and groupings, all cylinder pistons having the same stroke. This feature allows staging output or separate usages of the output of each piston. This may be accomplished when using a fluid distribution means including common internal manifolds, (11, 17 in FIGS. 3, 5 and 30) or a fluid distribution means utilizing individual external manifolding 50 (FIG. 31) or a fluid distribution means including direct piping and connections 52 to and from individual cartridges 5 and 9, without the need for internal or external manifolds. As shown in FIG. 30, carefully selected proportional sizes of individual cartridge units 54 and 54*a* or selected groupings of proportionally sized cartridge units 55 and 55*a*, will accurately meter and/or mix given ratios of separate fluids from the same pump for metering pumps and industries requiring a broad range of fluid handling requirements.

Circular internal manifolds 11, 17 as shown in FIGS. 3–5 may be utilized in common or blocked by appropriately designed cartridge units or other means as shown in FIG. 30. This option enables varying cylinder combinations for multiple fluid circuit applications.

As illustrated in FIG. 30, appropriately designed internal manifold plugs or functional blocking cartridges 56, as well as insert plug cartridges 58, may be used to seal and segment adjacent internal manifold areas of the device. By using replacement insert plug cartridges, individual devices may contain one or more pistons and matching inlet valves up to the number of corresponding radial bores in cylinder block 6. In this manner, cartridges may be selectively used or eliminated to determine the total number and position of the pumping pistons. An external inlet (suction) port 45 and external outlet (exhaust) port 46 is required for each separate manifold division.

Internal manifold cavities 11, 17 (FIG. 30) may also be optionally eliminated and each cartridge may be individually piped externally of the machine (FIG. 31). Whether using blocked, common, internal manifolds, or isolated piping to the cartridges or external manifolds, by pairing pumping piston circuits with cylinder bores 180 degrees in opposition and utilizing an even number of cylinders, unbalanced rotary vibrations can be minimized.

Rhythmic fluid-power pulsations can also be produced and utilized by purposeful sequential ordering of larger and smaller piston cartridge units in the radial cylinder block bores. Examples of applications of this feature would include compact deep drilling operations, jackhammers, shakers, separators, and vibratory equipment utilizations of many types.

Modular Stacking:

Multiple devices D (FIGS. 2, 32 and 33) of individually widely varying displacements and/or independently variable output may be close coupled or stacked to operate in line while driven by one common drive shaft without modification of the device or equipment. Devices D may also have varying peripheral dimensions and shapes with a common axis. The device D may have a circular peripheral shape of the device, or may be multi-faceted as a polyhedron, hexagonal, octagonal, or other configuration.

Figure 32:
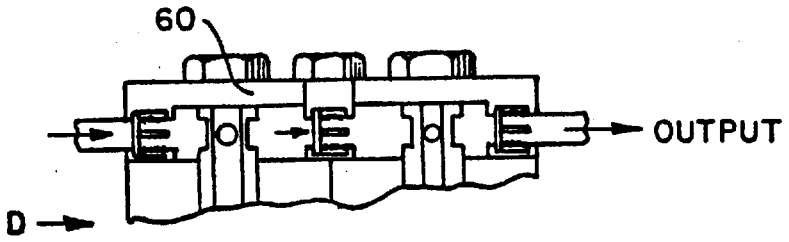
FIG. 32 is a schematic diagram of the machine showing two units arranged in series staging to increase output.
Figure 33:
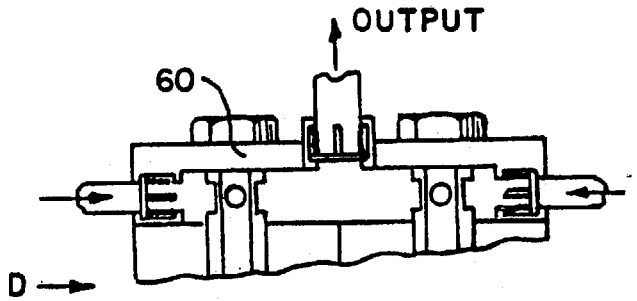
FIG. 33 is a schematic diagram of the machine showing two units arranged in parallel to increase output.

This feature is made possible by internal and external splines 42, 42*a* (FIG. 5) on shortened drive shaft 1 as well as a compact circular body design. This allows the separate pumping of individual fluid circuits by one drive shaft, including the simultaneous pumping of separate fluids. When combined with the continuously variable displacement feature, the device offers on-demand pumping of individual fluid circuits with differing flow rates and pressures, accomplished by one drive shaft with varying input RPM. As shown in FIG. 32, modular stacking also provides a convenient layout for staging output. As shown in FIG. 32, this may be accomplished with an incremental increase of pressure by connecting in series a high pressure output of one unit to a low pressure inlet of the next device. Similarly, as shown in FIG. 33, incremental increase of volume may be accomplished by paralleling the output volume of more than one pump. As illustrated, this may be accomplished through a common external manifold 60 but, of course, may also be achieved with separate manifolds and/or external piping.

The radial piston fluid machine described above offers many advantages. It is mechanically simple in structure, modular in design and offers a variety of static and dynamic adaptations of displacement control including: fixed; manually-adjustable fixed; manually-actuated, dynamically variable; and automatic, load-sensing, dynamically continuously-variable. In one embodiment it uses a separate or pilot pressure source to provide the fluid pressure necessary to control the stroke of the device for variable output functions while running under load. In another embodiment, the pumped fluid output or system pressure may be used for self-contained control purposes without reliance on external (pilot) pressure sources. This configuration permits the use of system pressure to control the stroke of the device for start-up under load and running under load conditions, thereby effectuating total dynamically-controlled continuously-variable displacement or output.

In another aspect, modular and interchangeable parts within a given device allow adaptation to a broad range of sizing or other requirements while maintaining high peak operating efficiency standards within the given design specifications, and further allowing additional maintenance and inventory control improvements through the design and the standardization of parts. In yet another aspect, the modular external shape permits a compact system of stackable units thereby facilitating manufacture and use, and allowing the simultaneous separate pumping of different fluid circuits and/or different fluids from a single drive shaft, with each isolated pump ultimately capable of providing independent control of widely varying flow rates and pressure requirements, and further providing a convenient layout for staging incremental increases of pressure and/or volume from multiple units utilizing a single drive shaft or even staging from one cylinder to another in the same unit. In a further aspect a modular piston and cylinder cartridge system is provided thereby allowing easy access and/or replacement for many purposes including: maintenance requirements, displacement changes, changing the number of pistons used, material composition changes, fluid medium requirements, flexibility of hookup locations and methods and valving and lubrication options.

Cartridges of differing displacements may be provided in an alternating sequential order for the purpose of generating rhythmic vibratory pulsations for advantageous use in equipment such as hydraulic excavators, dump-truck beds, shakers and separators, jack-hammers, compact deep-drilling applications, etc. The modular configuration also allows a single device to be segmented into individual pumping components such that one pump/compressor body will serve to pump separate fluid circuits and/or different fluids, as well as output staging from a single device. Means may be provided to segment fluid circuits using common internal manifolds which are appropriately blocked, or alternative direct-piping connections to the individual intake and exhaust of each cylinder. This feature allows any number or combination of fluid circuits wherein the total number of circuits possible equals the total number of pistons used, and an even number of cylinders having a mechanical balancing advantage.

Overall fluid mechanics system energy losses are reduced by improving the factors affecting peak operating efficiency including the use of mechanical friction reduction improvements and optimizing the design factors related to fluid flow. Fluid mechanics system efficiencies are further improved by weight reductions and simplification of fluid-power and fluid-handling systems through increased pressure capability, and improved features of dynamic variable control and other new system design opportunities. The machine is durable, can withstand heavy radial and axial loads, and can be mounted directly to working components such as drive shafts, pulleys, and gears, etc., thus further improving the total system efficiency by the simplification of fluid-power transmission system design.

The bearing and race system fitted around an adjustable-fixed or continuously-variable offset eccentric rotor assembly, when using lubricating liquids, transfers load to a hydrostatically loaded bearing recessed in a seat in the base of a piston skirt, therefore substantially reducing sliding friction wear factors to these components. The circular concepts include interior reductions of restrictions which affect fluid flow, further increasing fluid dynamic efficiencies and enhancing manufacturability.

The geometric layout of the system results in the vector forces of the load being applied in radial symmetry to the axis of drive, therefore transmitting these forces directly through heavy duty bearings to prime components in a manner that substantially reduces or even virtually eliminates off-loading on shafts and bearings, and further utilizes rolling load-bearing surfaces as opposed to sliding load-bearing surfaces, thus improving the ability to sustain heavy radial loading and reducing friction related problems. The pumped fluid medium may be used for lubrication of prime components such as the rotor, shaft and casing which are often the most expensive to replace. However, the design does not require these components to be lubricated in this manner. Such components can be isolated and lubricated separately where it is desirable to prevent contact with the pumped fluid either to prevent contamination of the pumped fluid or the lubricant or to avoid damage to the components caused by incompatibility of materials. Therefore, contamination induced wear is eliminated in these areas. Components subject to high wear, such as piston shoes, cylinders, and valves, are easily replaced.

In order to provide optimum geometric efficiency in the context of modular design, the axis of the shaft is short for the purpose of stacking units without the burden of excessive length and related problems of undue torsional shaft dynamics or the need for pump or equipment modifications such as connector plates, adapters, brackets, or support mechanisms.

The fixed and variable displacement features of this device encompass a range of control options including: fixed; manually-adjustable fixed; manually-actuated, dynamically variable; and automatic, load-sensing, dynamically, continuously-variable that ultimately offers the ability to continuously control output while starting and running under load.

Thus, an externally accessible cartridge system is provided offering a number of serviceability and performance advantages including, but not limited to:

a. Easy external access for interchangeability of the total displacement of a pump or compressor by selectively changing all cartridges to ones of different displacement.

b. Easy external access for interchangeability of selected sizes of pistons/cartridges to obtain required displacements for fluid dispensing and ratio-metering needs.

c. Easy external access for interchangeability of cartridges of differing displacements to create predictable rhythmic pulsations.

d. Easy external access for interchangeability of cartridges for inspection, maintenance, and repair.

e. Easy external access for interchangeability of cartridges of differing material composition or valving to allow pumping of alternative fluid mediums.

f. Easy external access for elimination of functional cartridges to alter the number of pistons used.

g. Easy external access for providing a means to block self-contained, common internal manifolds when segmenting the pump.

h. A means for providing self-contained, common, internal manifolds for accepting the cartridges, or optionally;

i. A means for providing individual isolation of cartridges by direct-piping to external manifolds or hook-ups.

j. By utilizing proper control valving, certain variations of (a–f) may be accomplished while under operation.

Other advantages will be apparent to those skilled in the art.

In the embodiments shown in FIGS. 34–45, for clarity, component numbers in the improved embodiments which are substantially similar in function to components in FIGS. 1–33 carry the same component numbers plus 100. Components which perform new or additional functions are numbered consecutively beginning with 201.

Figure 34:
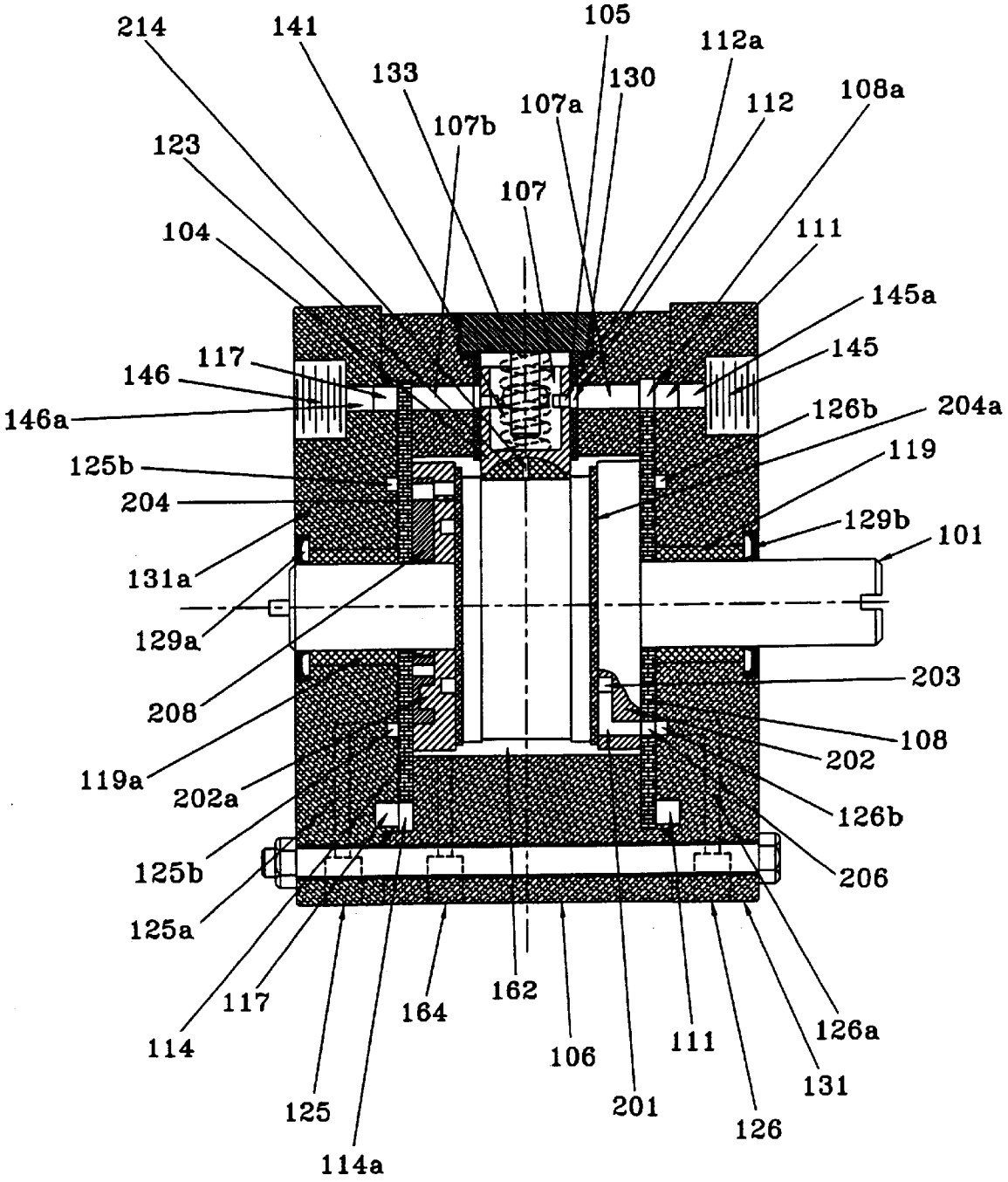
FIGS. 34–45 show various aspects of the improvements disclosed in this continuation in part application. More specifically.
Figure 35:
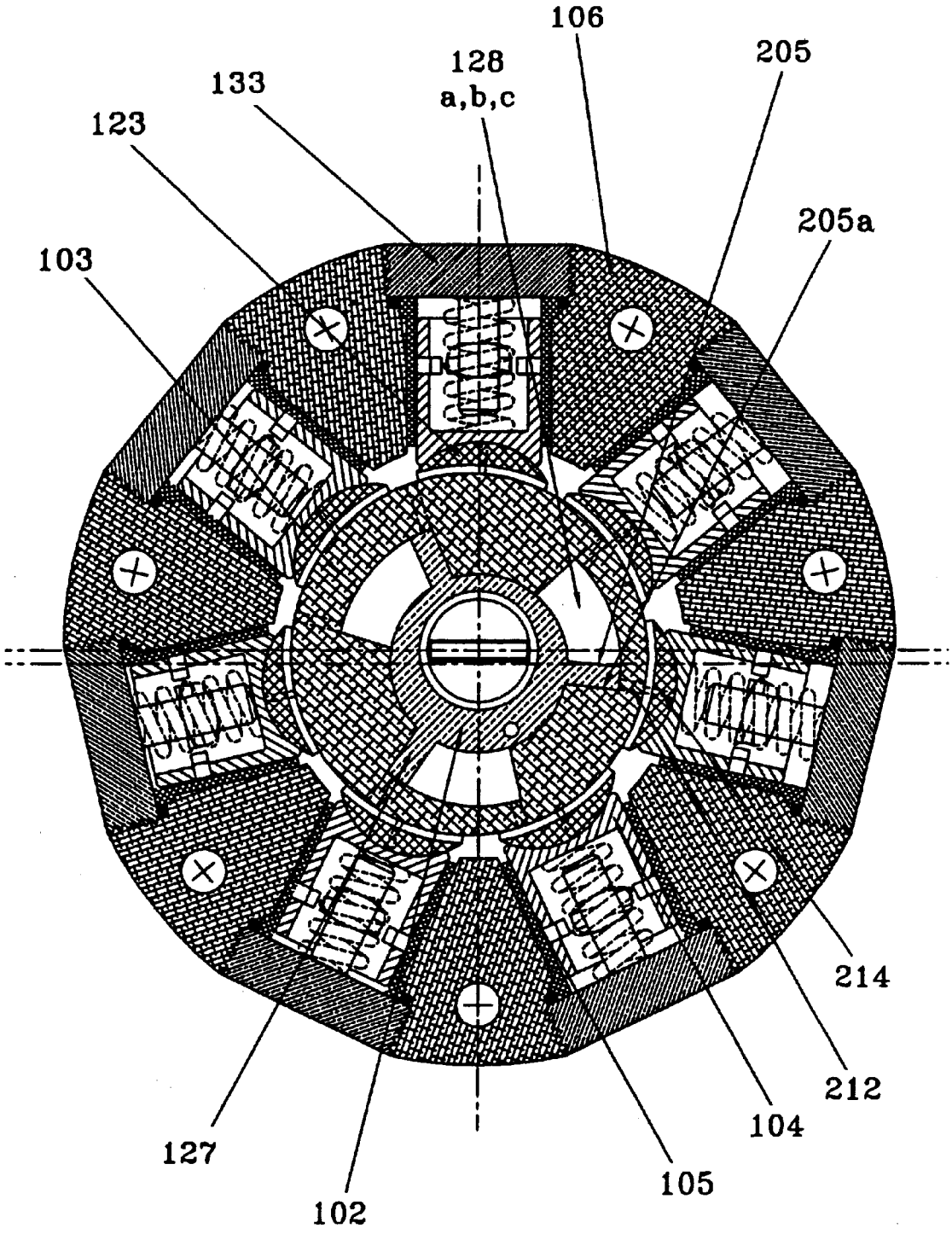
Figure 36:
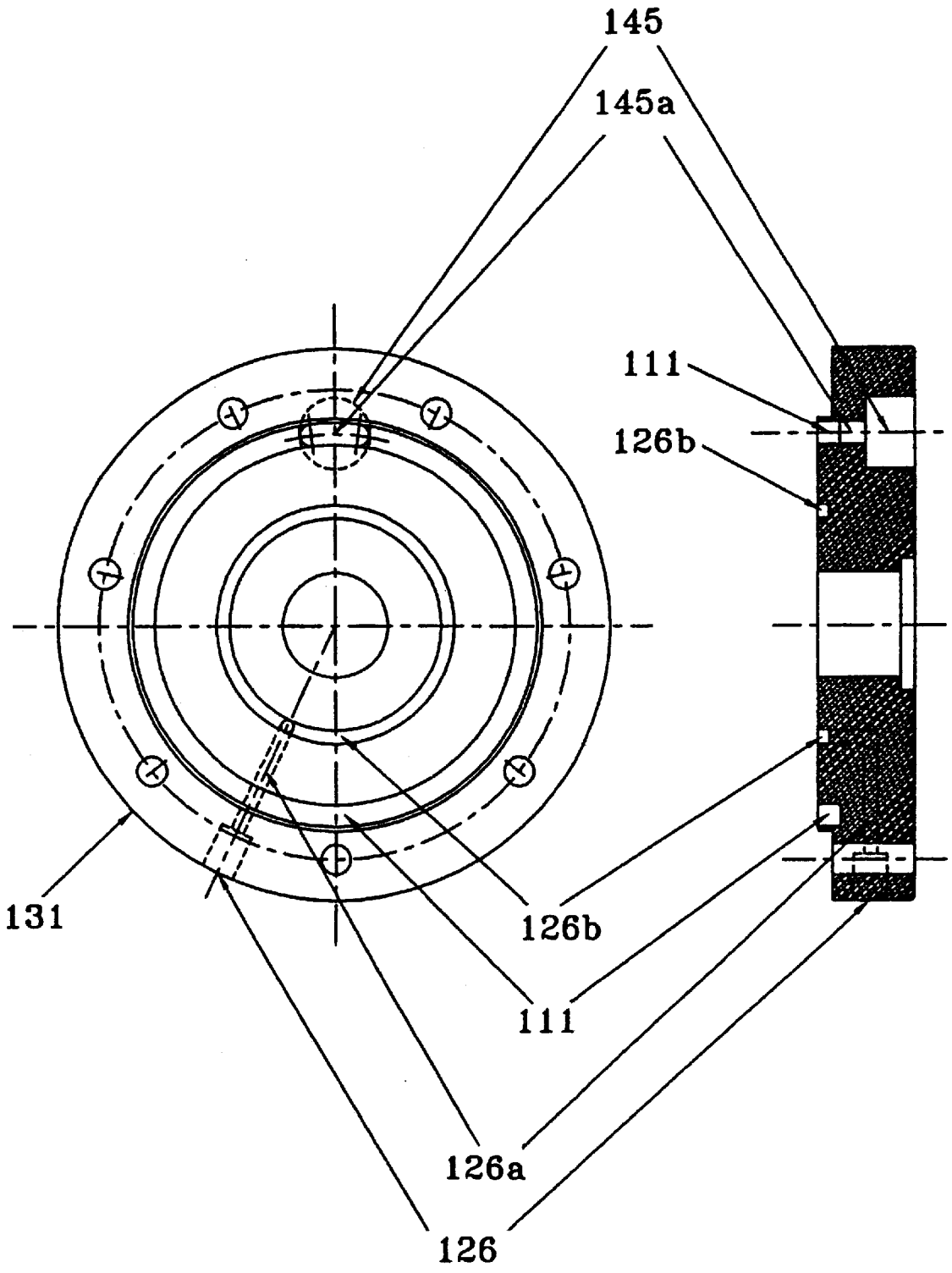

As shown in FIGS. 34, 35 and 36, the intake or inward stroke of cup shaped piston 104, assisted by a piston spring 141 and consequential to the rotation of shaft 101 and an offset moment of eccentricity, causes fluid to enter the low pressure fluid distribution system, comprising external inlet (suction) port and duct 145, 145*a*, a common annular (suction) manifold cavity 111, inlet valve plate cavity 108*a*, and a common fluid chamber series comprising inlet valve duct 107*a*, piston cavity 107 and exhaust valve duct 107*b*. Simultaneously, rotary intake valve plate 108 rotates within inlet valve plate cavity 108*a* to open a clearance with common (suction) manifold cavity 111 allowing fluid to enter the common fluid chamber series 107, 107*a* and 107*b* from manifold cavity 111 during approximately ½ of a rotational cycle, or top dead center to bottom dead center.

Continuing the cycle from bottom dead center to top dead center and conversely on the pressure stroke, rotary intake valve plate 108 closes the open clearance with common (suction) manifold 111 as piston 104 begins to rise in opposition to piston spring 141. Pressure is exerted throughout common fluid-filled chamber series 107, 107*a* and 107*b* while at approximately the same time rotary exhaust valve plate 114 rotates in exhaust valve plate cavity 114*a* to open a clearance with common (exhaust) manifold cavity 117. Fluid is expelled from the unit through high pressure outlet (exhaust) port and duct 146, 146*a*, respectively. Common fluid chamber series 107, 107*a* and 107*b*, valve plate cavity 114*a*, common (exhaust) manifold cavity 117, outlet port and duct (146 and 146*a*) comprise the high pressure fluid distribution system.

It should be noted that in this embodiment circumferential cartridge port slots 112 and circumferential piston port slots 112*a* are continuously open to the common fluid chamber series 107, 107*a* and 107*b* at all positions of piston stroke. It will be readily observed that the piston reciprocating port slots might be offset so as to open and close with the cylinder ports as an effective valving means (particularly in lower pressure applications), eliminating the need for rotary valves, rotary valve timing and/or other benefits. The piston could also be made with a shorter cup eliminating the need for ports in the piston to provide direct communication between port slots 112 at top dead center, thus providing a smaller diameter for the pump.

As shown in FIGS. 34, 35, 36, 40 and 44, the rotational control and locking of the secondary eccentric ring 103, when slideably fitted about the primary eccentric 102, is accomplished by the use of external fluid control pressure introduced by a separate (pilot) pressure pumping source, or alternatively supplied by the pumped fluid output (system pressure). This is accomplished without the use of rotary shaft seals or drilled passages within the rotating shaft.

As further illustrated, this control pressure is separated into two opposing differential fluid pressure control circuits that are ported to cover plates 131 and 131*a* using two threaded holes 125 and 126 following the control fluid pressure duct passages 125*a* and 126*a* in carriage cover plates 131*a* and 131, respectively, allowing control fluid to circulate in annular control fluid grooves 125*b* and 126*b*, respectively. The opposing differential control fluid pressure circuits are further directed through a control fluid passage slot 206 in valve plates 108 and 114 (see FIG. 37). Fluid passage slot 206 delivers this fluid to timing case 202 and 202*a* (see FIG. 38) with axial control fluid passage 201 and 201*a* and then to a common fluid manifold 203 and 203*a*. Rotor disks 204 and 204*a* (shown in FIG. 39) provide axial containment of fluid pressure in rotor cavities 128*a*, 128*b* and 128*c* and control fluid distribution ports 205 and 205*a*, ducting fluid pressure to each cavity chamber A and B (FIG. 40) on opposite sides of each control vane 127 (see FIGS. 35 and 40). The disks 204 and 204*a* provide a sliding and/or sealing fit with the primary and secondary eccentrics.

Figure 39:
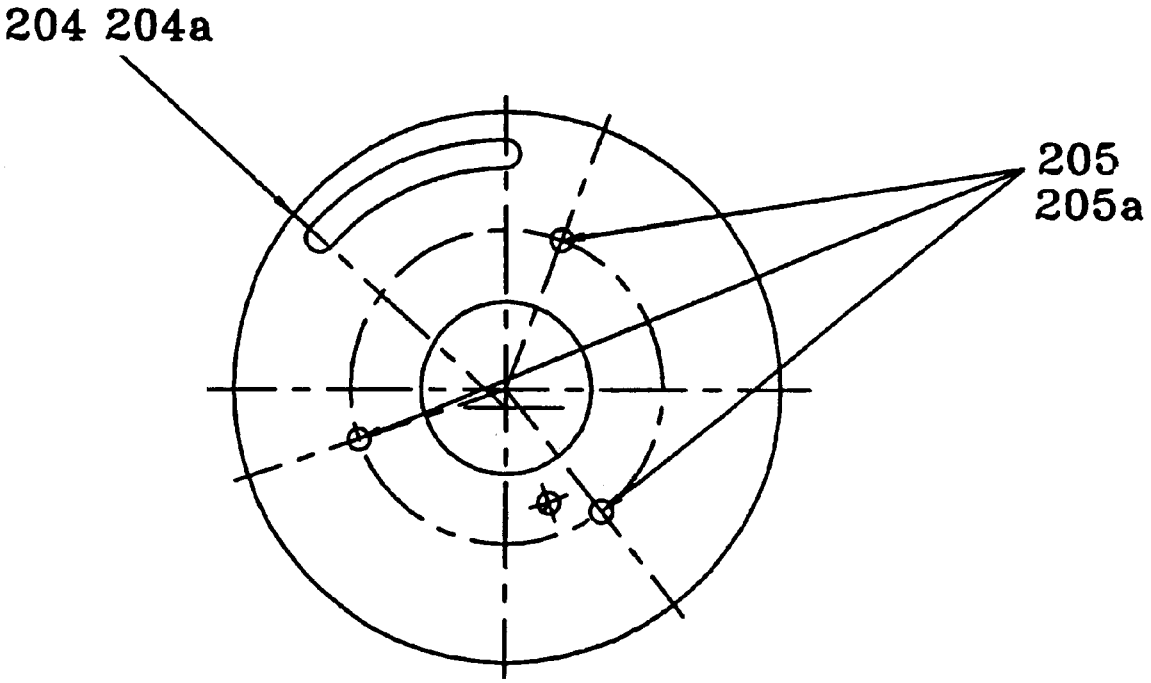
Figure 40:
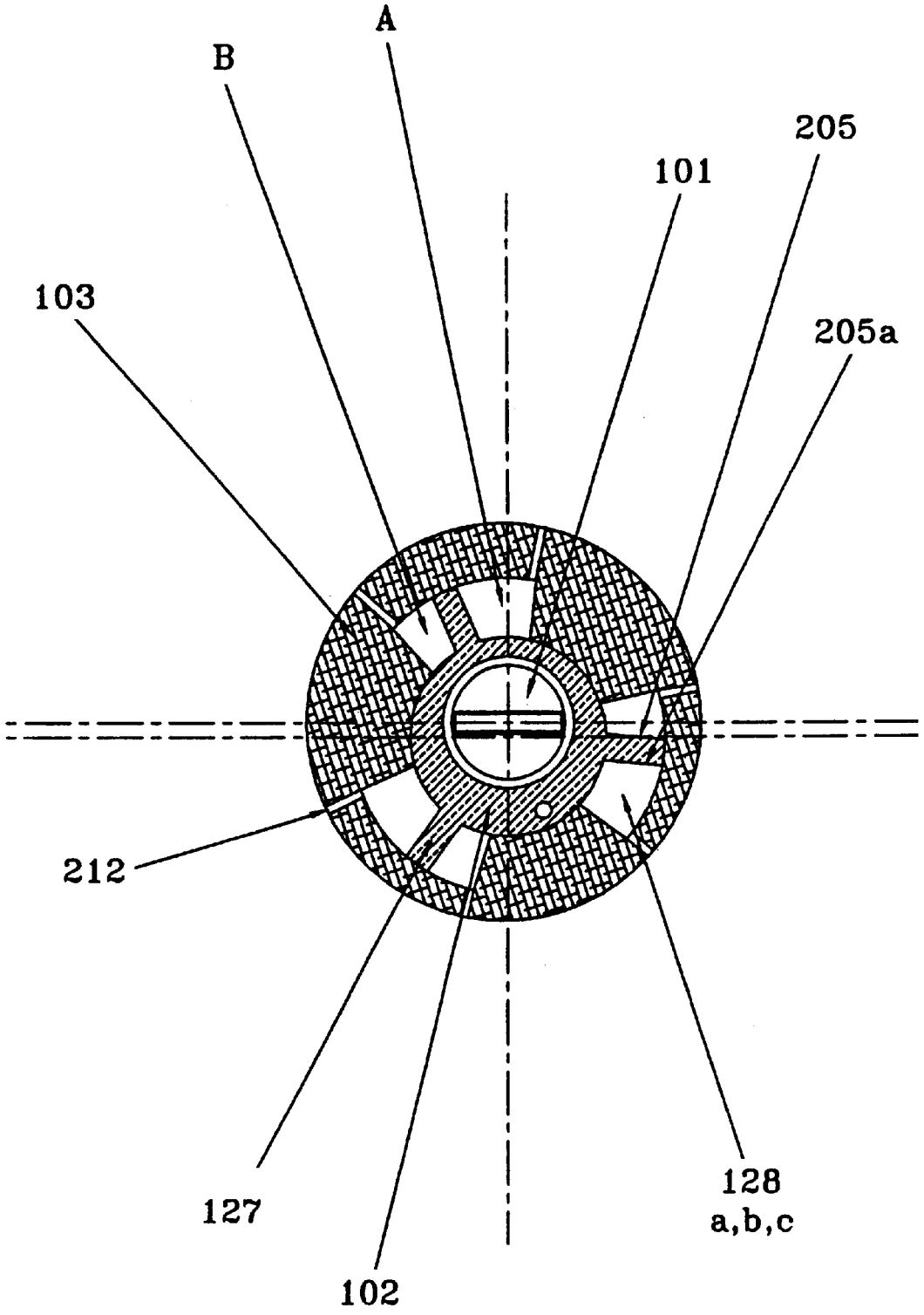
Figure 41:
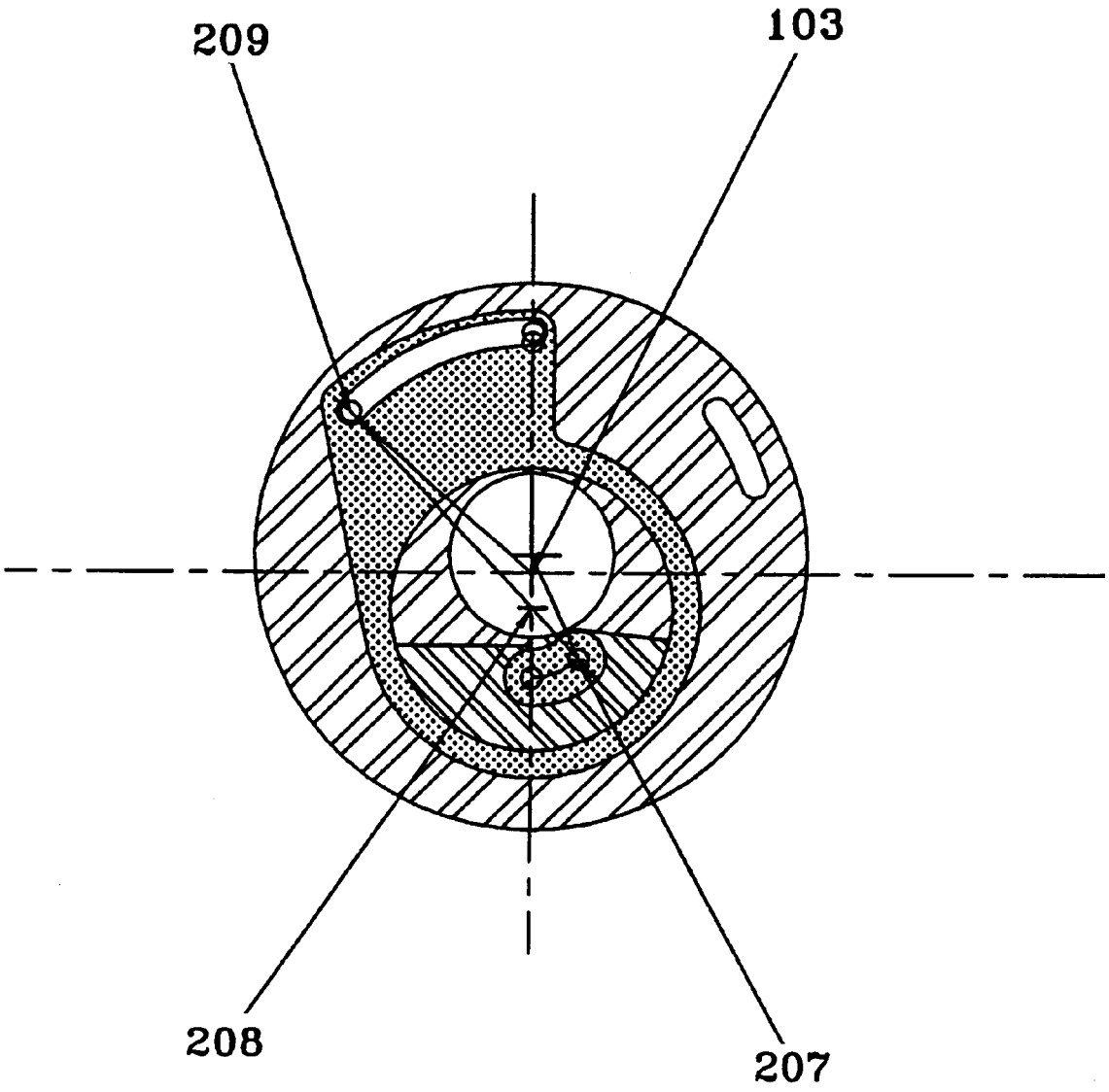
Figure 42:
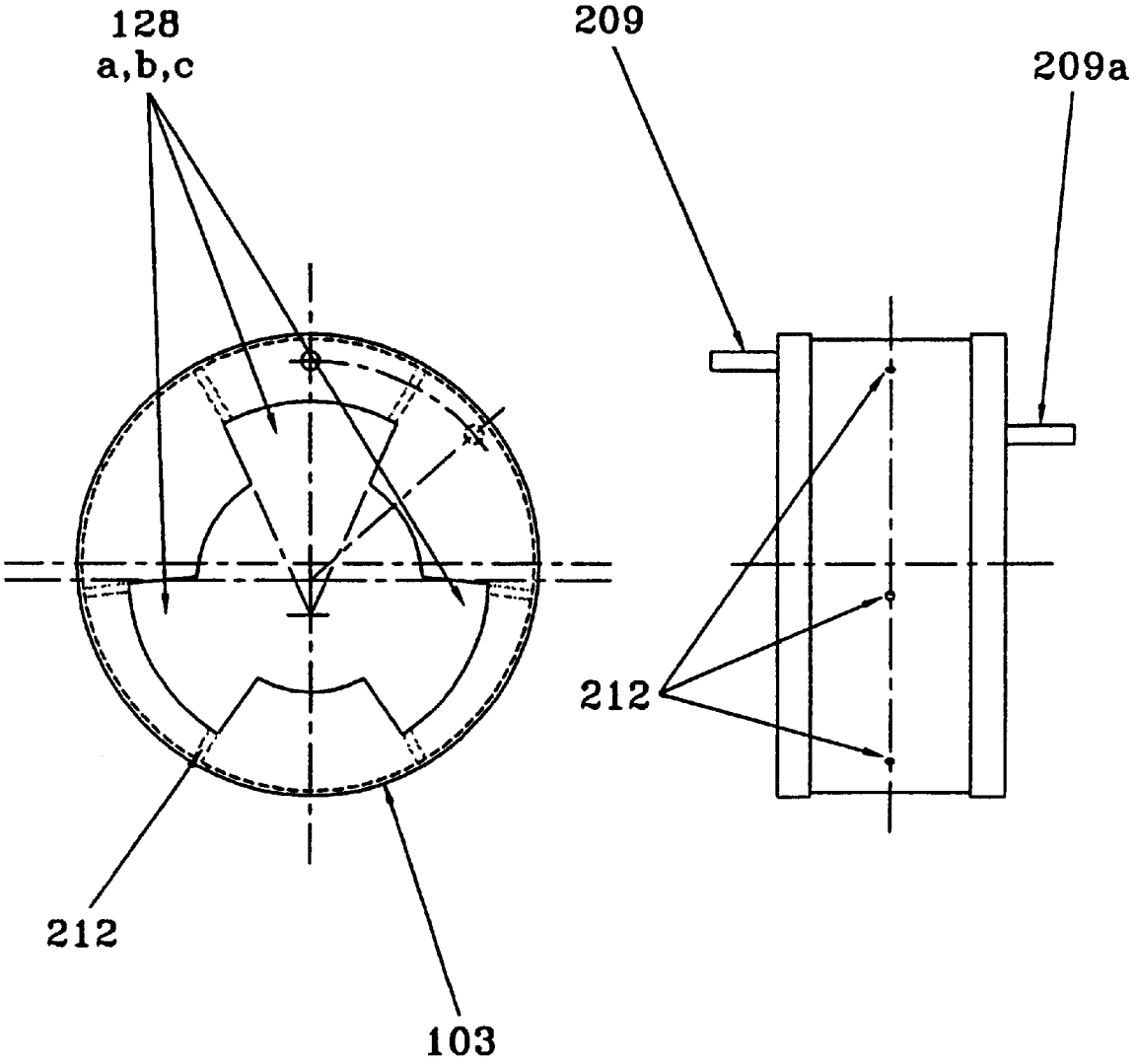
Figure 43:
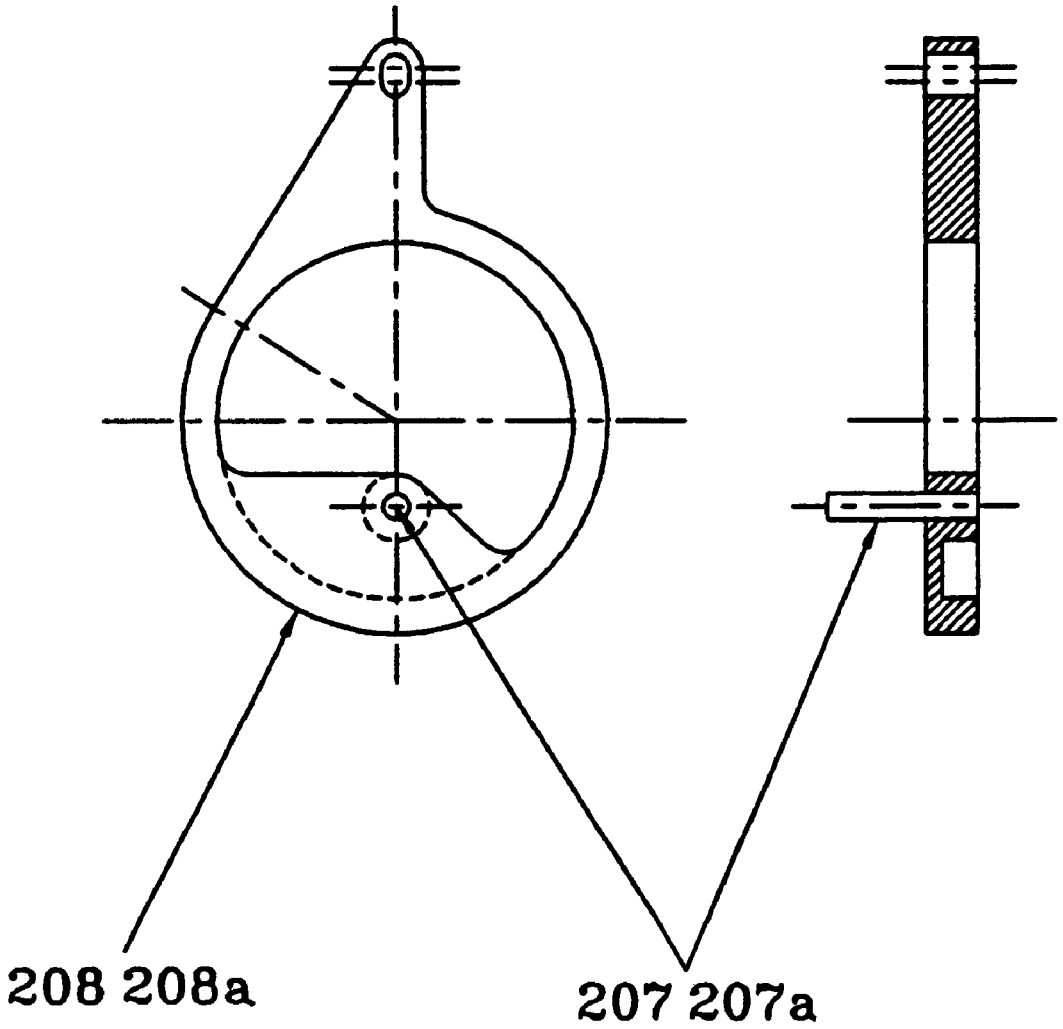

As particularly shown in FIGS. 35 and 40, three control vanes 127 are radially located on the circumference of and integral with primary eccentric 102. Thus, the differential fluid pressure control circuits are directed into three internal vane recess groove cavities 128, each fluid control circuit acting in vectored opposition on control vanes 127 and on the opposing internal reactive surfaces of primary eccentric 102 and secondary eccentric 103 and is axially confined within the cavity by containment surfaces provided by rotor disks 204 and 204*a* of FIG. 34. Alternatively, fluid pressure axial containment may be provided by cover plates. This improvement allows control fluid pressure routing in a manner that eliminates the need for high pressure rotary shaft seals or drilled passages within the rotating shaft and allows simple options for manufacturing close tolerance rotor components. Timing cases 202 and 202*a* (FIG. 38) and rotor disks 204 and 204*a* (FIG. 39) are fixed relative to the primary eccentric and vanes 102/127 (FIG. 40) by a locking pin inserted in lock pin hole (FIGS. 39 and 40). Valve plates 108 and 114 (FIG. 37), are driven independently by a timing mechanism (FIGS. 38 and 43) by means of valve drive pins 207 and 207*a* attached to timing links 208 and 208*a* operating in timing case 202 and 202*a*. Timing link 208 and 208*a* are in turn driven by timing link drive pins 209 and 209*a* in secondary eccentric 103 (FIG. 42). As shown in FIG. 41, the pivot center of timing links 208 and 208*a*, the radius location of drive pins 207 and 207*a*, and the radius location of driven pins 209 and 209*a* constitute a geometric relationship within the timing case mechanism such that relative rotation between the primary and secondary eccentrics will control valve port timing by means of the timing case mechanism.

Figure 44:
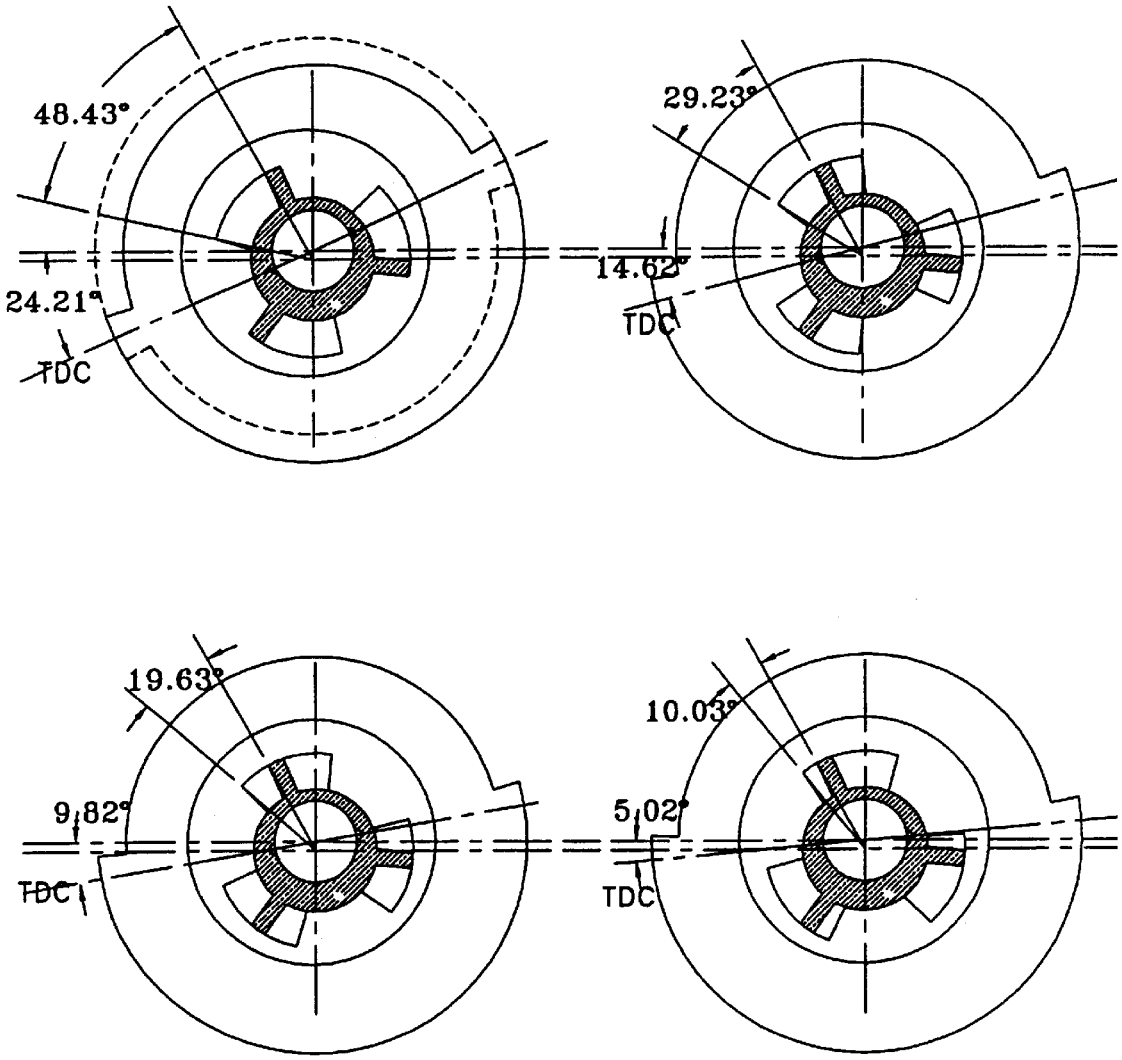

As shown in FIG. 44, controlling valve port timing while simultaneously altering eccentricity with the primary and secondary eccentrics will eliminate missed timing caused by directly coupling the valve plate to either the primary or the secondary eccentric. Such missed timing can produce effects such as loss of efficiency, excessive noise, hydraulic lock and subsequent pump damage. The timing mechanism further enables advanced or retarded valve timing for each inlet valve plate and outlet valve plate. A single valve plate and timing mechanism may be used to perform both inlet and exhaust functions; however, by incorporating separate timing mechanisms as shown in FIG. 34 for valve timing, inlet and outlet valve timing can be controlled independently for maximum pump efficiency and volumetric performance, particularized for differences in fluid behaviors such as gas compression or internal combustion.

When a source of fluid pressure external to the rotor is used to control the adjustable rotor assembly as illustrated in FIG. 40, the control vane 127 is shown integral with primary eccentric 102 (or, alternatively, a separate vane loaded by springs, hydraulically, magnetically, etc.) producing a sliding, fitted, sealing contact into each vane recess groove 128. This effectively separates each vane recess groove cavity 128 to form two distinct expandable and collapsible chambers A and B. These opposing differential fluid control pressures are communicated through this circuitry into chambers A and B of each vane recess groove 128 and, when appropriately regulated or controlled, resultant pressure differentials between chambers A and B cause a subsequent rotation of the secondary eccentric ring 103 about primary eccentric 102 as the relative size of chambers A and B increases and decreases accordingly.

The use of multiple vanes, as shown in FIG. 40, multiplies the acting differential pressure forces thereby multiplying the produced rotational torque between the primary and secondary eccentric. This allows for a commensurate reduction in size of the eccentrics for any given supply pressure.

Other Applications

Embodiments as illustrated in FIGS. 34–45 show examples of adjustable rotor use for pumping applications. Other applications can make use of the adjustable rotor mechanism. By fixing either the primary eccentric or secondary eccentric relative to an axis, control fluid can be used to actuate the rotatable eccentric element, which may then be used as a rotating cam for use in locking or pressure clamping such as in press die clamping for sheet metal processing. The small size and cylindrical segments lend themselves to being easily incorporated within the die plate itself. Other applications of multiple adjustable rotors on a single shaft include dynamically controlling valve operation, displacement compression ratio and balance mechanisms for shafts. In these embodiments it is clear that the secondary eccentric need not be circular but may take advantage of other traditional or non-traditional shapes and masses. Further, the apparatus could be constructed about a fixed geometric axis without requiring a physical shaft.

Internally Self Contained Control Means

Figure 45:
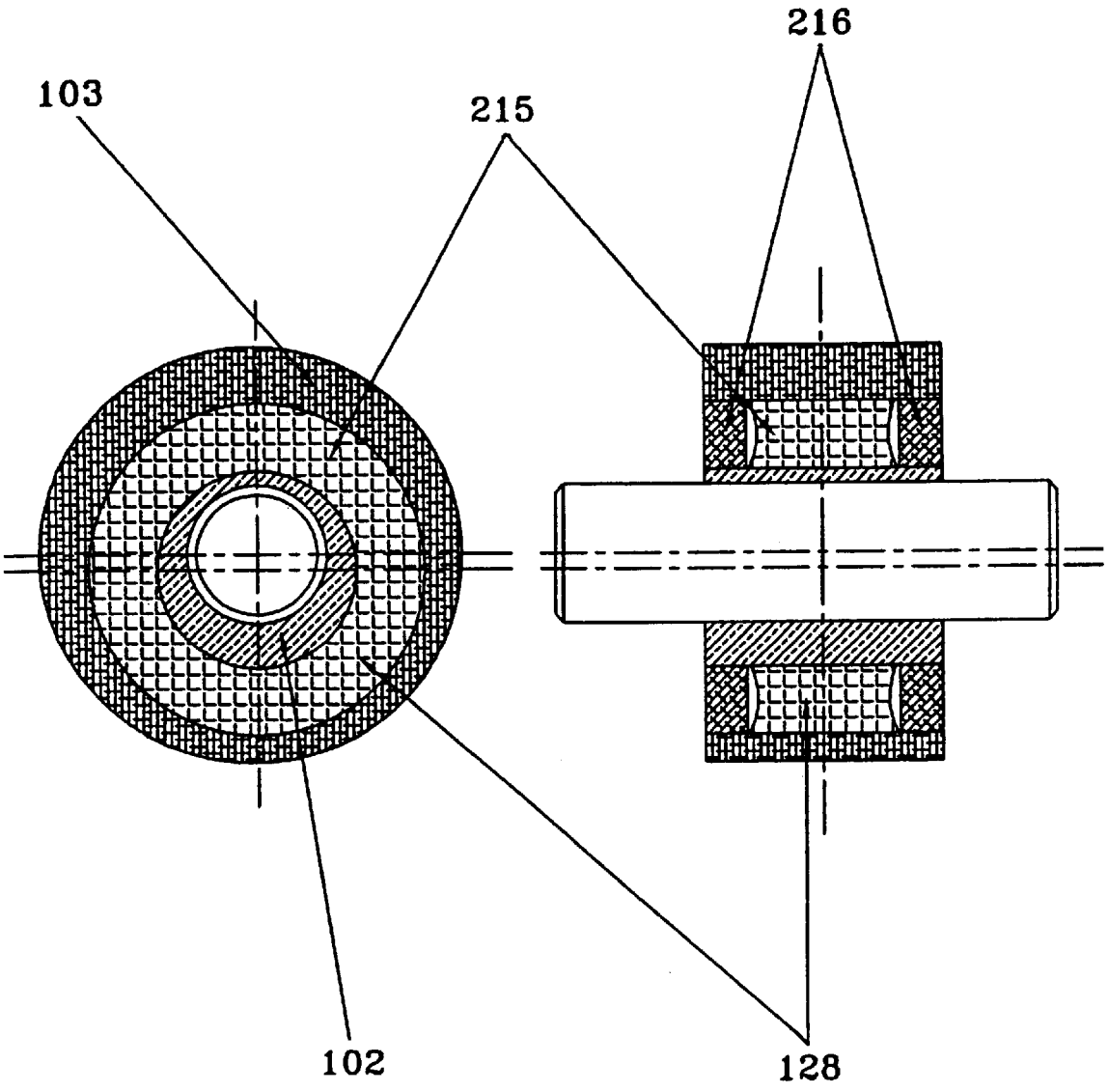

Both the embodiments in FIGS. 18–20 and FIGS. 34–43 allow for a source of dynamic control which is external to the rotor mechanism and requires supplementary external means for supplying control fluid pressure such as pilot or system pressure and may contain an external means for supplying control as a function of time. FIG. 21 illustrates a combination of both an internal source and an external source of dynamic rotor control. FIGS. 22, 23 and 45 show embodiments which do not require a control source external to the rotor, but rather, illustrate dynamically pre-programmed rotor mechanisms which provide internal rotor control in response to desired performance criteria designed into the rotor mechanism itself. The improvement in FIG. 45 as opposed to those in FIGS. 21–23, does not require a vane or vanes, but employs a torsional control ring which is attached to both the secondary and primary eccentrics.

The improvements shown in FIG. 45 show an annular cavity between the primary and secondary eccentric, said cavity extending through a full 360 degrees, in which the torsional control ring is installed. In a specific embodiment an elastic material 215 along with bearing 216 forms the control ring and is bonded or otherwise attached to the inner circumferential surface of the secondary eccentric and the outer circumferential surface of the inner eccentric. As illustrated in FIG. 45, the elastic material 215 is not attached to inner surfaces of bearing plates 216, allowing for maximum rotational movement. The elastic material could include an elastomer, elastic materials including metal, springs or other mechanical elastic devices to construct the torsional control ring. The bearing plates 216 attach to the secondary eccentric, rotate on the primary eccentric and carrying radial loads. During operation the pumping torque load causes a torsional rotation opposed by the torsional control ring through its resistive elastic material. The consequent rotation of the secondary eccentric relative to the primary eccentric thus changes the pump stroke. By suitably selecting the characteristics of the materials which control the elasticity and damping of the torsional control ring the pump can be pre-programmed to predictably respond to torque loading, temperature, torsional and axial vibrations or other dynamic loading factors. The use of a torsional control ring may provide for manufacturing advantages in the areas of cost and simplicity, among others.

Lubrication

Figure 37:
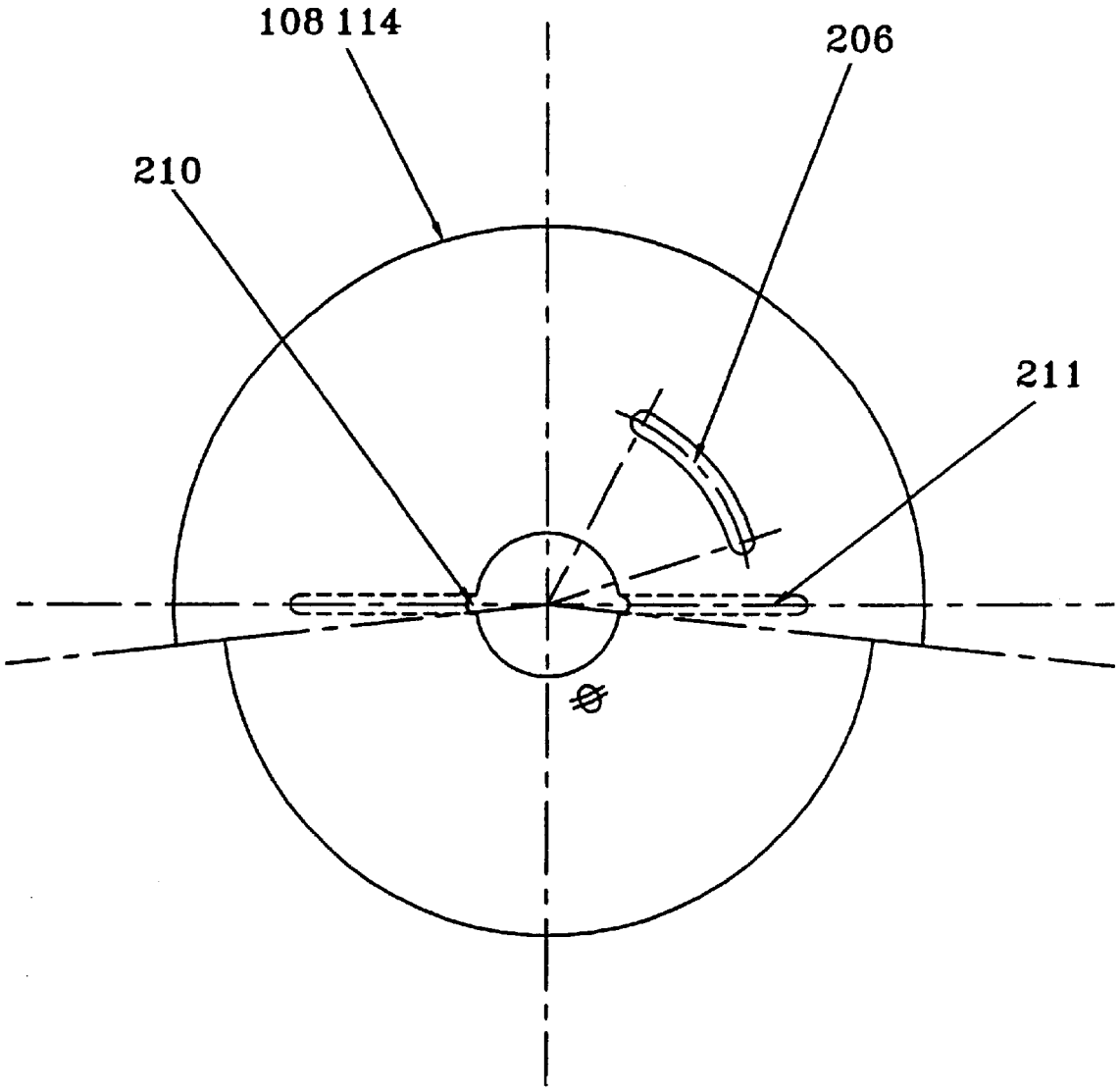
Figure 38:
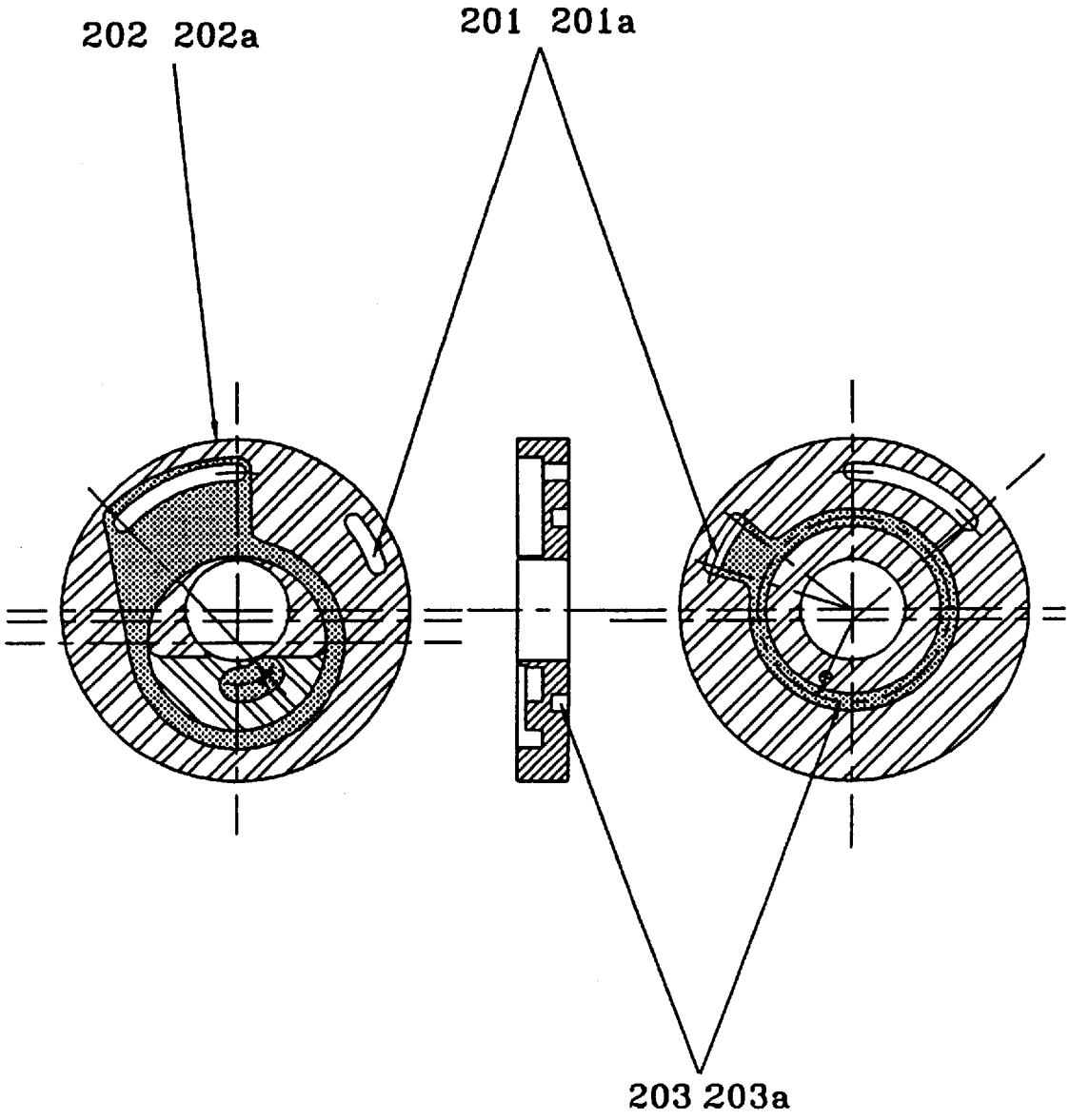

Lubrication of pump components may be provided by the working fluid or a lubricating fluid from an external source such as the control fluid, as shown in FIGS. 34, 35 and 37. Due to the high pressure differential between the control fluid from the annulus 125*b* and the case cavity 162 (see FIG. 34) fluid bleeds through the clearance between valve plate 114 and carriage cover plate 131*a* toward the shaft 101. This fluid, now at or near the ambient case pressure, is used to lubricate the shaft roller bearing assembly 119 and 119*a*. Additionally, excess fluid passes through slot 210 (see FIG. 37) in valve plate 114 and then through lubrication groove 211 and into the case cavity 162 where it exits out the case drain 164 shown in FIG. 34. Lubrication groove 211 is open to the face of the timing case 202 shown in FIG. 38 which is now filled with fluid providing lubrication for timing link 208 (see FIG. 43). In like manner the valve plate, roller bearing assembly and timing link are lubricated on the opposite side of the device (see FIG. 34).

A piston shoe 123, shown in FIGS. 34 and 35, is provided to distribute piston loading uniformly over the bottom of piston 104. Because of the reduced contact pressures, low wear and longer operating life can be expected. For some applications piston shoes may be self lubricated by use of Teflon® or a similar material or oil impregnated powdered metal to reduce or eliminate the use of a fluid lubrication system. The spherical ball segment of the piston shoe 123 is mated to a spherical ball cavity in the bottom of the piston 104. As the secondary eccentric rotates relative to the primary eccentric to provide an offset and stroke there will be a continuing change in the angle the tangent to the eccentric makes with the perpendicular to the piston axis as the shaft rotates through 360 degrees. The piston shoe provides the continuously adjusting interface between the eccentric and the piston making full contact with the eccentric surface and the bottom cylindrical segment of the shoe 123 and full pivoting contact with the spherical segment of the piston bottom. Illustrated in FIG. 35 is the position of each piston and shoe. Note the pivoted positions of each piston shoe as it adjusts to both the piston and the eccentric.

The piston shoe 123 as illustrated in FIGS. 34 and 35 is lubricated using control fluid from cavities 128 of FIGS. 40, 35 and 42 which allows lubrication fluid to bleed through lubrication ports 212 to lubricate the bottom of the cylindrical segment of piston shoe 123. As the secondary eccentric 103 rotates, the ports 212 pass repeatedly across matching ports 214 in the piston shoe 123 of FIG. 35. During each intake stroke, piston pressure is at a minimum so that lubricating fluid within cavities 128, which is maintained at high pressure, can pass through port 214 and lubricate the bottom spherical segment of piston 104.

Various changes and modifications will be apparent to those skilled in the art, which fall within the scope of the following claims.

What is claimed is:

1. A radial piston fluid machine comprising

A. a cylinder block including at least one piston bore extending radially in said block, a low pressure fluid distribution system comprising a means of fluid communication between a low pressure fluid source and said piston bore, and a high pressure fluid distribution system comprising a means of fluid communication between a high pressure fluid source and said piston bore, B. means controlling fluid communication between said low pressure fluid distribution system and said high pressure fluid distribution system, C. a casing mounted centrally of said block, D. bearings fitted within a central part of said casing, E. a centrally located shaft supported and journalled on said bearings, the center of said shaft intersecting the centerline of said bore, F. an eccentric means, G. a piston in said piston bore operatively connected to said eccentric means, H. intake and output ports in said cylinder blocks for intake and output of fluid to and from said cylinder block, I. an inlet plate which is moveable with respect to all of said intake ports to control fluid flow through said intake ports, and J. an outlet plate which is moveable with respect to all of said output ports to control fluid flow through said output ports.

2. A radial piston fluid machine according to claim 1 wherein said piston terminates centrally of said cylinder block in a spherically concave cavity and mates with a spherically convex piston shoe.

3. The radial piston fluid machine of claim 1 and further comprising a timing mechanism operatively connected to said eccentric means for controlling the movement and position of said inlet and outlet plates with respect to said eccentric means.

4. The radial piston of claim 2 wherein said piston reciprocates radially in said piston bore while said piston bore is held stationery with respect to said cylinder block.

* * * * *